US005699045A

United States Patent [19]

Frederick et al.

[11] Patent Number: 5,699,045

[45] Date of Patent: Dec. 16, 1997

[54] ELECTRONIC ARTICLE SURVEILLANCE SYSTEM WITH CANCELLATION OF INTERFERENCE SIGNALS

[75] Inventors: Thomas J. Frederick, Coconut Creek, Fla.; Steven Goodrich, Irving, Tex.; Dale R. Bettine, Coral Springs, Fla.

[73] Assignee: Sensormatic Electronics Corporation, Boca Raton, Fla.

[21] Appl. No.: 656,949

[22] Filed: Jun. 6, 1996

[51] Int. Cl.[6] ..... G08B 13/187

[52] U.S. Cl. ..... 340/551; 340/572

[58] Field of Search ..... 340/572, 551

[56] References Cited

U.S. PATENT DOCUMENTS

| | | | |
|---|---|---|---|
| 4,859,991 | 8/1989 | Watkins et al. | 340/572 |
| 4,975,681 | 12/1990 | Watkins et al. | 340/572 |
| 5,602,531 | 2/1997 | Rude et al. | 340/572 |

OTHER PUBLICATIONS

Louis L. Scharf, *Statistical Signal Processing*, pp. 103–111 and 323–333, Addison–Wesley Pub. Co.

J. Evans et al., "Analysis and Implementation of Variable Step Size Adaptive Algorithms," IEEE Transactions on Signal Processing, vol. 41, No. 8, Aug. 1993, pp. 2517–2535.

B. Widrow et al., "Adaptive Noise Cancelling: Principles and Applications," Proceedings of the IEEE, vol. 63, No. 12, Dec. 1975, pp. 1692–1716.

P.P. Vaidyanathan, "Multirate Digital Filters, Filter Banks, Polyphase Networks, and Applications: A Tutorial," Proceedings of The IEEE, vol. 78, No. 1, Jan. 1990, pp. 56–93.

V. John Mathews, "Performance Analysis of Adaptive Filters Equipped with the Dual Sign Algorithm," IEEE Transactions on Signal Processing, vol. 39, No. 1, Jan. 1991, pp. 85–91.

V. John Mathews et al., "Improved Convergence Analysis of Stochastic Gradient Adaptive Filters Using the Sign Algorithm," IEEE Transactions on Acoustics, Speech and Signal Processing, vol. ASSP–35, No. 4, Apr. 1987, pp. 450–454.

G.F. Franklin et al., *Digital Control of Dynamic Systems*, pp. 40–49, 2d Ed., Addison–Wesley Pub. Co.

A. Papoulis, *Probability, Random Variables and Stochastic Processes*, pp. 205–217, 2d Ed., McGraw–Hill Book Co.

*Primary Examiner*—Glen Swann

*Attorney, Agent, or Firm*—Robin, Blecker, Daley and Driscoll

[57] ABSTRACT

An electronic article surveillance system includes a signal generator for generating an interrogation signal in an interrogation zone, an antenna which receives a signal present in the interrogation zone, and interference cancelling circuitry for cancelling interference components in the signal received by the antenna. The interference cancelling circuitry includes a hybrid interference component cancelling loop in which a digital interference estimate signal is formed and converted into an analog estimate signal, and the analog estimate signal is subtracted from an input analog signal. The resulting difference signal is processed with a hybrid automatic gain control loop. A digitized signal, formed from the resulting difference signal, is subjected to digital interference cancellation processes in addition to the hybrid interference component cancellation process. Each of the digital interference cancellation processing and the hybrid interference component cancellation loop entails performing a respective polyphase decomposition of a digital input signal, estimating a mean value of each of the resulting subsequences, and combining the estimated mean values to form an interference component estimate signal. An input sample window provided for a comb-filtering stage is adjusted in phase relative to the cycle of the interrogation signal to compensate for changes in phase of the marker signal to be detected.

66 Claims, 13 Drawing Sheets

DETECTION PROCESSING

TRACKER MODES

WAVEFORM SMOOTHER

DETECTION STATE MACHINE

INPUT SIGNAL

FILTERED OUTPUT SIGNAL

PHASE-ADJUSTED
INPUT SIGNAL

FILTERED PHASE-ADJUSTED
SIGNAL

ELECTRONIC ARTICLE SURVEILLANCE SYSTEM WITH CANCELLATION OF INTERFERENCE SIGNALS

FIELD OF THE INVENTION

This invention is related to electronic article surveillance (EAS) and, more particularly, is concerned with removal of interference from signals received in EAS systems.

BACKGROUND OF THE INVENTION

It is well known to provide electronic article surveillance systems to prevent or deter theft of merchandise from retail establishments. In a typical system, markers, designed to interact with an electromagnetic field placed at the store exit, are secured to articles of merchandise. If a marker is brought into the field or "interrogation zone", the presence of the marker is detected and an alarm is generated. On the other hand, upon proper payment for the merchandise at a check-out counter, either the marker is removed from the article of merchandise or, if the marker is to remain attached to the article, then a deactivation procedure is carried out which changes a characteristic of the marker so that the marker will no longer be detected at the interrogation zone.

In one type of widely-used EAS system, the electromagnetic field provided at the interrogation zone alternates at a selected frequency and the markers to be detected include a magnetic material that produces harmonic perturbations of the selected frequency on passing through the field. Detection equipment is provided at the interrogation zone and is tuned to recognize the characteristic harmonic frequencies produced by the marker. If such frequencies are present, the detection system actuates an alarm. An EAS system of this type is disclosed, for example, in U.S. Pat. No. 4,660,025 (issued to Humphrey and commonly assigned with the present application).

It is often the case that EAS systems are deployed in locations at which substantial interfering electromagnetic signals are present. In addition to the usual 60 Hz radiation and harmonics generated by the building power system, other interfering signals are likely to be emanated from electronic cash registers, point-of-sale terminals, building security systems, and so forth.

It is common to install signal shields adjacent to the transmitting and detecting antennas in order to minimize the possibility that the interrogation signal will interfere with other equipment located near the EAS system, while also reducing the chance that the system will detect interfering signals or marker signals originating from outside of the interrogation zone. Unfortunately, the shields themselves tend to interact with the interrogation signal and ambient 60 Hz radiation by producing harmonics of both signals as well as components formed by intermodulation of the interrogation and power line signals. The resulting intermodulation components are at frequencies which correspond to sums and differences of integer multiples of the interrogation and power line frequencies. The presence of these interfering signals can make it difficult to operate EAS systems in a satisfactory manner.

Moreover, there is usually phase coherence among the interfering signals and the marker signals detected, because it is customary to derive the interrogation signal by phase-locking with the power line. When digital signal processing is employed, the digital sampling clock also is typically derived from a reference signal phase-locked to the power line.

It is well known to adjust EAS systems among settings corresponding to greater or smaller degrees of sensitivity. When a system is adjusted so as to be relatively sensitive, the likelihood of permitting an EAS marker to pass through the interrogation zone undetected is decreased, but at the cost of possibly increasing susceptibility to false alarms. Conversely, if the sensitivity of the system is lowered, the susceptibility to false alarms is reduced, but there may be an increase in the risk that a marker will pass through the interrogation zone undetected. Thus, adjustment of the EAS system often involves a tradeoff between reliable performance in terms of detecting markers (sometimes referred to as "pick rate") and susceptibility to false alarms. The presence of interfering signals tends to make it difficult to achieve an acceptably high pick rate without also incurring an unacceptable susceptibility to false alarms.

To overcome this problem, it has been known to perform certain signal conditioning or filtering upon the signal received by the detection equipment before that signal is processed to determine whether a marker is present in the interrogation zone. In a known technique used for removing interference signals, disclosed in U.S. Pat. No. 4,975,681 (which is commonly assigned with the present application), interference is removed from the signal received in the EAS system by subtracting a delayed version of the received signal from the received signal itself. Details of this prior art technique will now be described with reference to FIG. 1, in which reference numeral 20 generally indicates the prior art EAS system.

The EAS system 20 includes a phase lock loop/frequency multiplier circuit 22 which generates a reference signal that is phase-locked to a local power line signal. From the reference signal, the circuit 22 generates a transmit clock signal at a desired system transmitter frequency (for example, 73.125 Hz). The transmit clock signal is supplied to a transmitter circuit 24. The transmitter circuit 24 drives a transmitting antenna 26 to radiate an interrogation field signal 28 into an interrogation zone 30. The interrogation field signal 28 is generated in synchronism with the transmit clock signal supplied to the transmitter circuit 24.

An EAS marker 32 is present in the interrogation zone 30 and radiates a marker signal 34. The marker signal 34 is received at a receiving antenna 36 along with the interrogation field signal 28 and various noise and interference signals present from time to time in the interrogation zone 30. Among these signals may be harmonics of the interrogation signal, power line signal radiation and its harmonics, components formed through intermodulation of the power line signal and the interrogation field signal by shielding members (not shown), Barkhausen noise, and signals generated by other equipment (not shown) such as point-of-sale terminals, scanners and so forth.

The signals received at the antenna 36 are amplified at a preamplifier 38 and the resulting amplified signal is provided to an analog signal conditioning circuit 40. The signal conditioning circuit 40 performs analog filtering with respect to the amplified received signal. For example, the signal conditioning circuit 40 may be a bandpass filter which attenuates signals having frequencies below about 600 Hz (thereby removing the interrogation field signal, power line radiation and low harmonics thereof), and also attenuates signals above about 8 KHz, which is beyond the band which includes harmonic signals of interest.

The filtered signal output from the signal conditioning circuit 40 is provided to an analog-to-digital converter 42, which converts the filtered signal into a digital signal. The digital signal formed by the A/D converter 42 consists of a sequence of digital samples formed in synchronism with a sample clock signal supplied to the A/D converter 42. The sample clock signal is generated by phase-lock loop/frequency multiplier circuit 22. The PLL/frequency multiplier circuit 22 generates the sample clock from the reference signal that is phase-locked to the local power signal.

The digital signal formed by the A/D converter 42 is delayed for a predetermined period in a delay line circuit 46, and then the delayed signal is converted to an analog signal by digital-to-analog converter 48. Both the delay line circuit 46 and the D/A converter 48 operate in synchronism with the sample clock signal generated by PLL circuit 22. The delayed analog signal formed by the D/A converter 48 is subtracted from the filtered signal output by the analog signal conditioning circuit 40 at an analog summing junction 50. The resulting signal is then converted to a digital signal at A/D converter 52, which operates in synchronism with the sample clock signal generated by PLL/frequency multiplier 22. A digital signal processing circuit 54 performs marker detection processing on the digital signal formed by A/D converter 52. If the DSP circuit 54 determines that a marker is present in the interrogation zone, the circuit 54 actuates an indicator device 56, which generates a visible and/or audible alarm or takes other appropriate action.

The delay imparted by delay line 46 is selected to match the period of the interference signal to be cancelled at the junction 50. In particular, if the A/D converter 42 operates at a sampling frequency $F_s$ so that the interval between the samples produced by the A/D converter is $T_s=1/Fs$ and the period of the interference signal to be cancelled is $N\times T_s$, then the delay line 46 imparts a delay of N samples to the digital signal. The delay may be selected so as to match the period of the interrogation field signal or the power line signal, or the "subharmonic" of those two signals, that is, the frequency which is the largest that has both the interrogation field signal and the power line signal as harmonics.

Disregarding non-ideal characteristics of the converter circuits and the summing junction, the delay signal cancellation arrangement provides a discrete transfer function $H(z)=1-z^{-N}$, which is a comb notch filter with zeros at the frequencies $nF_s/N$, where n is a non-negative integer less than N/2.

While the delay signal cancellation arrangement of FIG. 1 produces benefits in terms of removing interference before digital marker detection processing is performed, it would be desirable to provide even better performance in terms of interference cancellation. For example, the comb notch filter implemented in FIG. 1 has wide stop-bands that tend to partially cancel the marker signal, particularly since the marker signal is correlated with the interference to be cancelled. Further, the filtering provided by the delay signal canceler has a fast time constant which provides very little smoothing of variations in the interference signal.

OBJECTS AND SUMMARY OF THE INVENTION

It is accordingly an object of the invention to provide an EAS system which includes circuitry for cancelling interference that is correlated with the marker signal to be detected by the system.

It is another object to provide an EAS system which includes circuitry for cancelling interference having characteristics that vary over time.

It is a further object of the invention to remove an interference signal that is correlated with a sampling clock signal generated in circuitry used to analyze a signal received in an EAS system.

It is still a further object of the invention to minimize quantization noise produced when a signal received by an EAS system is quantized prior to digital signal processing performed for the purpose of marker signal detection.

It is yet another object of the invention to remove from a signal received by an EAS system interference generated by intermodulation of a power line frequency and the transmitter operating frequency of the EAS system.

It is yet a further object to provide signal conditioning circuitry for an EAS system using less hardware than in conventional signal conditioning arrangements.

According to an aspect of the invention, there is provided an electronic article surveillance system which includes circuitry for generating and radiating an interrogation signal which alternates at a predetermined frequency in an interrogation zone, an antenna for receiving a signal present in the interrogation zone, and interference cancelling circuit for removing interference from an analog signal representative of the signal received by the antenna, the interference cancelling circuitry including a circuit for subtracting an analog estimated interference signal from the analog signal representative of the signal received by the antenna, to form a processed analog signal, an A/D converter for converting the processed analog signal into a sequence of digital samples, a digital signal processing circuit for processing the sequence of digital samples to form a digital estimate signal representative of an estimate of interference present in the analog signal, and a D/A converter for converting the digital estimate signal into the analog estimated interference signal to be subtracted from the analog signal by the subtracting circuit.

Further in accordance with this aspect of the invention, the digital signal processing circuit processes the sequence of digital samples by forming M subsequences from the sequence of digital samples (M being a positive integer greater than 1), estimating a respective mean of each of the M subsequences, and combining the estimated means of the M subsequences to form the digital estimate signal.

According to another aspect of the invention, there is provided an electronic article surveillance system, including circuitry for generating and radiating an interrogation signal which alternates at a predetermined frequency in an interrogation zone, an antenna for receiving a signal present in the interrogation zone, a gain amplifier for applying a gain to an analog signal representative of the signal received by the antenna, to form an amplified analog signal, the gain being in accordance with a gain setting signal supplied to the gain amplifier, an A/D converter for converting the amplified analog signal into a sequence of digital samples, and a digital signal processing circuit for processing the sequence of digital samples to form the gain setting signal to be supplied to the gain amplifier.

According to still another aspect of the invention, there is provided an electronic article surveillance system, including circuitry for generating and radiating an interrogation signal which alternates at a predetermined frequency in an interrogation zone, an antenna for receiving a signal present in the interrogation zone, circuitry for processing the signal received by the antenna to form a sequence of digital samples, and a digital signal processing circuit for forming M subsequences from the sequence of digital samples (M being a positive integer greater than 1), estimating a respective mean of each of the M subsequences, combining the estimated means of the M subsequences to form a digital estimate signal consisting of a sequence of digital estimate samples, and subtracting each sample of the sequence of digital estimate samples from a corresponding sample of the sequence of digital samples to form a sequence of processed digital samples.

With hybrid and digital signal conditioning provided in accordance with the invention, interference components correlated with signals to be detected, and having characteristics that vary over time, can be removed prior to marker detection processing, thereby improving over-all performance of the EAS system.

According to a further aspect of the invention, there is provided an electronic article surveillance system, including circuitry for generating and radiating an interrogation signal which alternates at a predetermined frequency in an interrogation zone, an antenna for receiving a signal present in the interrogation zone, circuitry for processing the signal received by the antenna to form a sequence of digital samples, the sequence of digital samples consisting of a sequence of sample frames, each sample frame corresponding to a respective cycle of the interrogation signal, windowing circuitry for sequentially selecting a respective subset of each of the sample frames, each subset consisting of the samples present in a window period within the respective interrogation signal cycle, the windowing circuitry adjusting a timing of the window period relative to the respective cycle according to a characteristic of the sample frame, and comb filtering circuitry for comb-filtering the sample frame subsets sequentially selected by the windowing circuitry. The windowing circuitry may include circuitry for estimating a phase, relative to the respective interrogation signal cycle, of a marker signal present in the respective sample frame, the windowing circuitry being arranged to adjust the timing of the window period according to the estimated phase of the marker signal.

According to still a further aspect of the invention, there is provided an electronic article surveillance system, including circuitry for generating and radiating an interrogation signal which alternates at a predetermined frequency in an interrogation zone, an antenna for receiving a signal present in the interrogation zone, circuitry for processing the signal received by the antenna to form a sequence of digital samples, the sequence of digital samples consisting of a sequence of sample frames, each sample frame corresponding to a respective cycle of the interrogation signal, the sequence of sample frames respectively including marker signals that vary in phase from sample frame to sample frame, relative to the respective interrogation signal cycle, and circuitry for estimating, relative to the respective interrogation signal cycle, phases of the marker signal included in the sample frames. The estimating circuitry according to this aspect of the invention may include circuitry for comb-filtering the marker signals included in the sample frames to form a filtered estimate of the marker signals, and circuitry for cross-correlating the filtered estimate of the marker signals with a selected portion of a current one of the sample frames.

The foregoing and other objects, features and advantages of the invention will be further understood from the following detailed description of preferred embodiments and practices of the invention and from the drawings, wherein like reference numerals identify like components and parts throughout.

DESCRIPTION OF THE DRAWINGS

FIGS. 18(*c*) and (*d*) are respectively the input signal of FIG. 18(*a*), after application of the phase-adjustment process of FIG. 16, and the resulting output signal of the waveform smoothing function.

DESCRIPTION OF PREFERRED EMBODIMENTS AND PRACTICES

A preferred embodiment of the invention will now be described, initially with reference to FIG. 2.

System Overview

Figure 1:
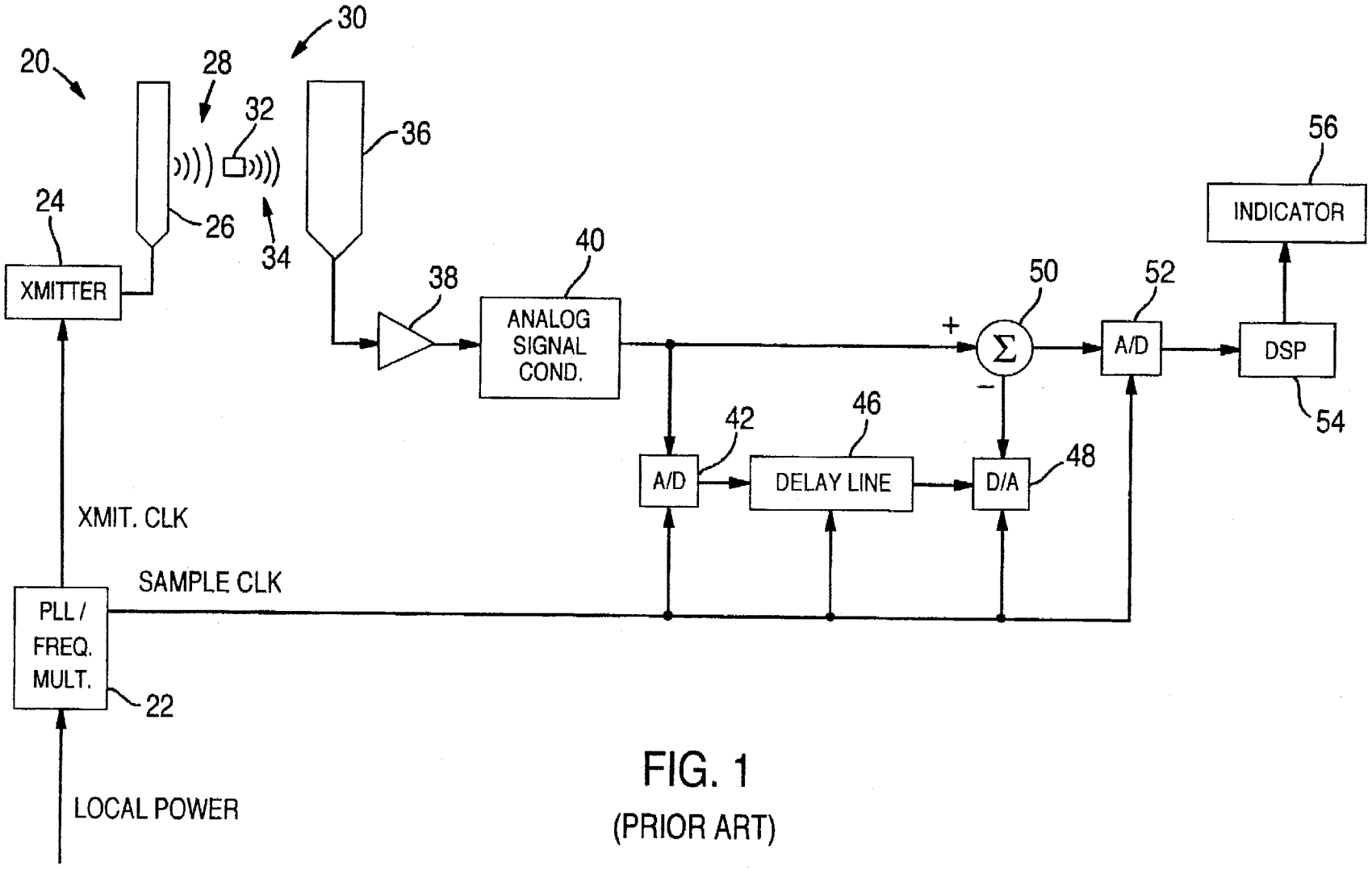
FIG. 1 (PRIOR ART)
FIG. 1 is a schematic block diagram of an electronic surveillance system provided in accordance with the prior art with circuitry for cancelling interference signals using a delay line.
Figure 2:
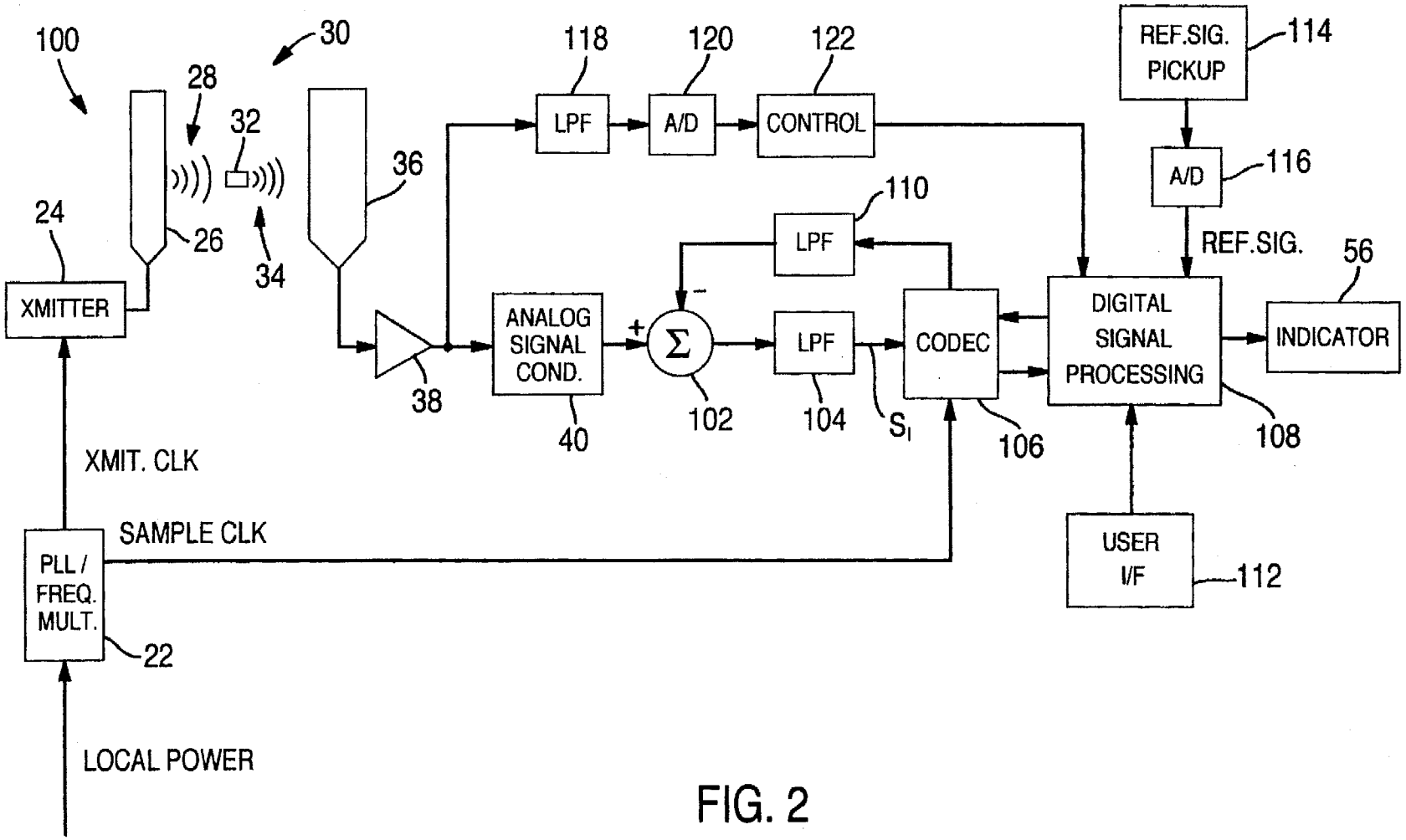
FIG. 2 is a block diagram of an EAS system provided with noise cancelling circuitry in accordance with the invention.

In FIG. 2, reference numeral 100 generally indicates an EAS system provided in accordance with the invention. The system 100 includes components indicated by reference numerals 22–40 and 56, which are preferably the same as corresponding components described in connection with the prior art system of FIG. 1. These components may be realized with hardware provided in commercially available EAS systems.

Although only one receiving antenna 36 is shown in FIG. 2, it should be understood that a preferred embodiment of the invention may include two or more receiving antennas, and the signals received through the receiving antennas may be processed in respective channels. This may be done using parallel processing hardware channels, or by time-sharing common processing hardware.

The signal receiving and processing circuitry of the system 100 includes an analog summing junction 102, which is connected to receive the filtered analog signal outputted from the analog signal conditioning circuit 40. The summing junction 102 subtracts from the filtered analog signal an analog estimated interference signal that is generated downstream from the summing junction 102 and is fed back to the summing junction 102. The signal formed by subtracting the analog estimated interference signal from the filtered analog signal is provided, through a low pass filter 104, as an input signal $S_I$ to a codec circuit 106. The codec circuit 106 processes the input signal provided through the LPF 104 by applying a gain to the input signal and then converting the resulting amplified signal into a sequence of digital samples formed in synchronism with a sample clock signal provided to the codec 106 by PLL/frequency multiplier circuit 22. The sequence of digital samples formed by the codec 106 is provided as an input signal to a digital signal processing circuit 108. The DSP circuit 108 performs digital signal processing with respect to the input signal received from the codec circuit 106 for the purpose of estimating a subharmonic interference component, cancelling power line and transmitter interference components, performing automatic gain control, performing other digital signal conditioning functions, and determining whether the signal received at the receiving antenna 36 is indicative of the presence of a marker 32 in the interrogation zone 30. The functions performed by the DSP circuit 108 will be described in more detail below.

On the basis of the signal processing performed by the DSP circuit 108, the indicator device 56 is selectively actuated to generate an alarm or take other appropriate action. The DSP circuit 108 also feeds back to codec 106 a digital signal indicative of an estimate of a subharmonic interference component present in the signal output from the analog signal conditioning circuit 40. This signal is converted into an analog signal by the codec 106 and then is provided to the analog summing junction 102 (by way of a low-pass filter 110) as the analog estimated interference signal.

Also provided from the DSP circuit 108 to the codec 106 is a gain control signal which determines the level of gain applied by the codec 106 to the input signal $S_I$.

The DSP circuit 108 is connected to a user interface device 112, through which input signals are provided to the DSP circuit 108 for the purpose of, e.g., setting parameters for use in interference component estimation. The DSP circuit 108 also receives a reference signal used for performing a reference-based noise cancellation process. The reference signal is provided to the DSP 108 by means of a reference signal pickup 114 and an analog-to-digital converter 116.

The amplified analog signal output from the preamplifier 38, in addition to being provided to the analog signal conditioning circuit 40, is low-pass filtered in LPF circuit 118, converted to digital form at analog-to-digital converter 120, and then provided as a digital signal to a control circuit 122. The control circuit 122 processes the digital signal inputted thereto to detect a fundamental level of the signal received by the receiving antenna 36. In accordance with the detected level, the control circuit 122 selectively provides to the DSP circuit 108 an inhibit signal which, for reasons to be discussed below, inhibits the DSP circuit 108 from updating estimates of interference components. As will also be seen, the DSP circuit 108 performs internal signal processing routines that selectively inhibit updating of interference component estimates.

Overview of Digital Signal Processing

The signal processing carried out in the codec 106 and DSP circuit 108 will now be described with reference to FIG. 3.

The input signal $S_I$ provided to the codec 106 is amplified at a variable amplifier block 124 inside the codec 106 in accordance with a gain signal G supplied to the codec 106 from the DSP circuit 108. The amplified signal is then converted into a digital signal at an analog-to-digital converter block 126 inside the codec 106, and the resulting digital signal is supplied to the DSP circuit 108. Within the DSP circuit 108, the digital signal is provided as an input to an automatic gain control block 132 and also is multiplied (as indicated by block 128) by a gain value 1/G that is the inverse of the gain value G applied at the variable amplifier block 124. The signal output from the multiplier block 128 is provided as an input to three functions performed by the DSP 108, represented respectively by a subharmonic estimator block 130, a power line interference canceller block 134 ($F_p$ canceller) and a power level monitor block 136.

The AGC block 132 processes the digital signal formed by ADC 126 to generate gain control values to set the gains provided by the multiplication block 128 and by the variable amplifier block 124 of the codec 106.

The subharmonic estimator block 130 processes the signal provided by the multiplier block 128 to generate a digital signal that is representative of an estimate of an interference component present in the filtered analog signal input to the summing junction 102. The digital estimate signal is output from the DSP circuit 108 to the codec 106. A digital-to-analog converter block 138 that is part of the codec 106 converts the digital estimate signal output from the DSP circuit 108 into the aforementioned analog estimated interference signal which is provided through the low-pass filter 110 to the summing junction 102.

The $F_p$ canceller block 134 processes the signal generated by the multiplication block 128 so as to attenuate an interference component corresponding to harmonic frequencies of the power line signal. The resulting signal provided by the block 134 is an input to a block 140 which performs a reference-signal-based noise cancelling process on the basis of the reference signal provided from the reference signal pickup 114 through A/D converter 116 (FIG. 2). The signal output from the reference canceller block 140 is provided as an input signal to an $F_o$ canceller block 142, which processes the signal to attenuate an interference component corresponding to harmonics of the interrogation signal frequency. The resulting signal output from the block 142 is provided as an input to a digital signal conditioning block 144, which, in turn, performs further noise attenuation processing. The resulting signal is then provided as an input to a marker detection processing block 146. The processing performed at the block 146 is carried out, in accordance with techniques to be described below, in order to determine a degree of likelihood that a marker is present in the interrogation zone. On the basis of this determination, the indicator 56 is selectively actuated. Also based on determinations made in the marker detection block 146, the subharmonic estimator block 130 and the transmit signal canceller block 142 are selectively inhibited from updating respective estimates of interference components. The latter two blocks are also inhibited from updating interference component estimates on the basis of a signal output from the power level monitor block 136. The inhibit signal selectively output from the block 136 is generated on the basis of processing performed with respect to the signal output from the multiplication block 128. Another inhibit signal provided to the blocks 130 and 142 is selectively output from the control circuit 122, based on processing that will be described below.

Hybrid Subharmonic Canceller

Figure 4:
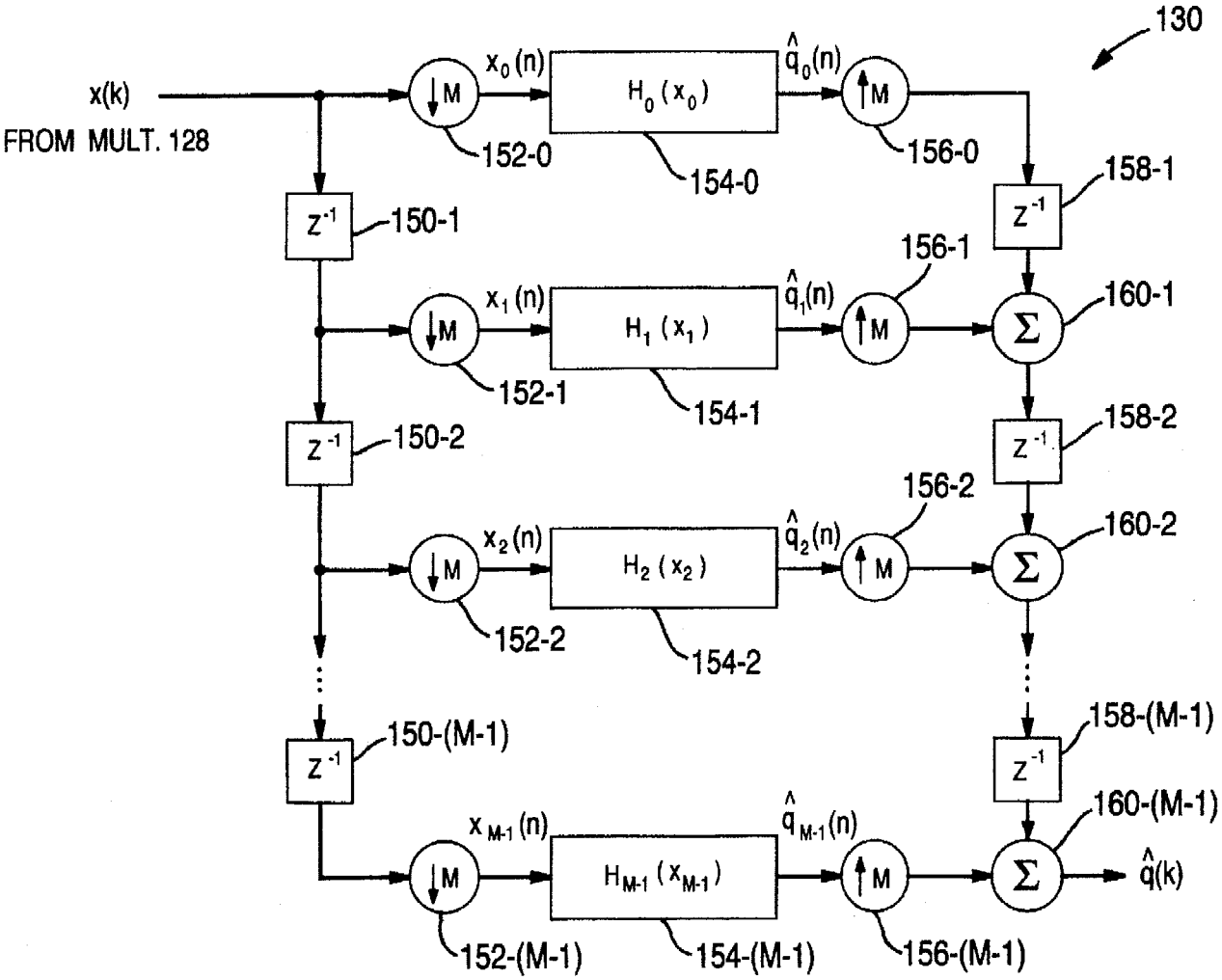
FIG. 4 illustrates in functional block form signal processing carried out by the digital signal processing circuit of FIGS. 2 and 3 for the purpose of estimating a subharmonic noise component present in signals received by the EAS system of FIG. 2.

The processing by which the subharmonic estimator block 130 generates the digital interference component estimate signal supplied to the codec 106 will now be described with reference to FIGS. 4 and 5. As shown in FIG. 4, the subharmonic estimator 130 receives an input digital signal x(k), which is a sequence of digital signals output from the multiplication block 128, and forms from the input signal M subsequences of digital signals $x_i(n)$, where i equals 0, 1, 2, . . . , M−1, and M is an integer greater than one. The subsequences $x_i(n)$ are known as a "polyphase decomposition" of the input signal and are formed by applying the input signal x(k) to a cascade connection of M−1 delay elements 150-1 to 150-(M−1). The input signal x(k) and the respective outputs from the delay elements 150-1 to 150-(M−1) are respectively provided to M-fold decimation blocks 152-0 to 152-(M−1). Each of the decimation blocks 152 subsamples its respective input sequence so that the output subsequences $x_i(n)$ have a sampling rate equal to $F_{sample}/M$, where $F_{sample}$ is the sample rate of the input signal x(k). Moreover, the subsequences are related to the input signal such that $x_0(n)=x(k)$, $x_1(n)=x(k-1)$, $x_2(n)=x(k-2)$, . . . , and $x_{M-1}(n)=x(k-(M-1))$. Moreover, in this case, $x_0(n+1)=x(k+M)$, $x_1(n+1)=x(k+M+1)$, $x_2(n+1)=x(k+M+2)$, . . . , $x_{m-1}(N+1)=x(k+1)$, and so forth.

Figure 5:
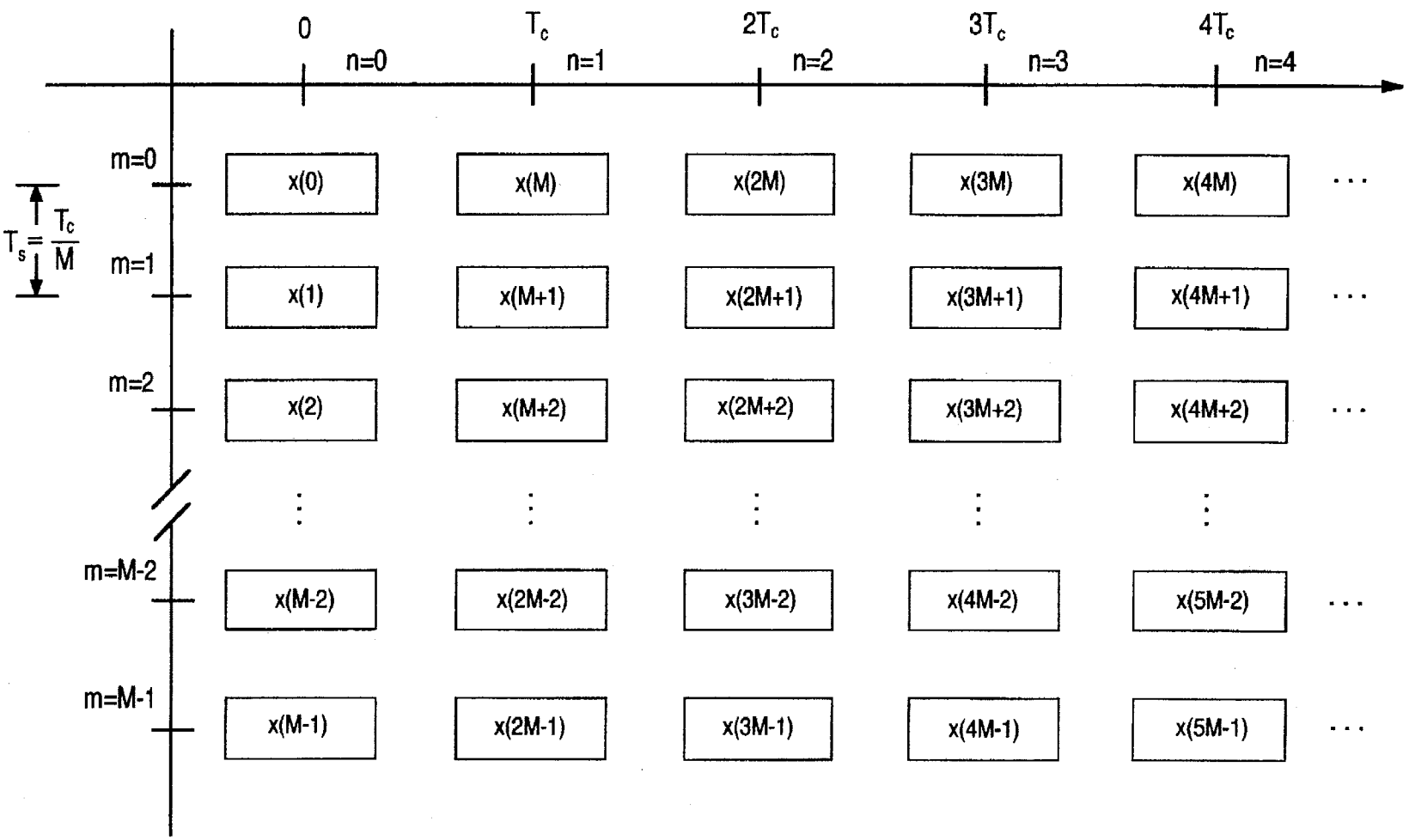
FIG. 5 illustrates a data array which represents a polyphase decomposition carried out by the DSP circuit for the purpose of estimating interference signal components.

FIG. 5 is a matrix representation of the M subsequences formed by the decimators 152. In FIG. 5, each of the M rows is representative of a respective one of the subsequences, with the index m in FIG. 5 corresponding to the index i of the subsequences $x_i$. The vertical dimension of the matrix of FIG. 5 is M, corresponding to the number of subsequences formed by the decimators 152, while the horizontal dimension of the matrix is arbitrarily long, corresponding to the indefinite length of the input sequence x(k) as well as the resulting subsequences. Each of the columns of FIG. 5 corresponds to a "frame" of the input signal, where the frame has a temporal duration $T_c=M\cdot T_s$, with $T_s=1/F_{sample}$. $T_c$ corresponds to the period of the interrogation signal $F_o$.

Referring again to FIG. 4, the subharmonic estimator 130 includes subsequence estimation blocks 154-0 to 154-(M−1). Each of the subsequence estimators 154 processes a respective one of the subsequences formed by the decimation blocks 152-0 to 152-(M−1) to form a respective sequence of estimate signals $\hat{q}_i(n)$. Each of the resulting estimate subsequences $\hat{q}_o(n)$ to $\hat{q}_{M-1}(n)$ is converted at a respective up-sampling block 156 to a subsequence having the same sampling rate as the input signal x(k). This is done by inserting M−1samples having the value "0" between each sample of the respective subsequence $\hat{q}_i(n)$. The resulting up-sampled subsequences formed by the up-sampling blocks 156-0 are combined by means of delay elements 158-1 to 158-(M−1) and summation blocks 160-1 to 160-(M−1) to form the digital estimate signal $\hat{q}(k)$ outputted from the subharmonic estimator block 130 to the codec 106. The digital estimate signal $\hat{q}(k)$ has the same sampling rate as the input signal x(k).

The digital estimate signal $\hat{q}(k)$ is intended to be an estimate of an interference component formed by intermodulation of the power line signal $F_p$ and the system transmitter frequency $F_o$, and harmonics of those two signals. It is therefore assumed that the interference component is substantially periodic in a frequency $F_{subharmonic}$, where $F_{subharmonic}$ is the largest frequency which has both $F_p$ and $F_o$ as harmonics. The number of subsequences M formed in the subharmonic estimator 130 is then taken as $F_{sample}+F_{subharmonic}$. Assuming that the input signal provided to the summing junction 102 is the sum of an interference component that is periodic in $F_{subharmonic}$ and wide sense stationary, white Gaussian noise, then the subsequences $x_i(n)$ would be constants with additive wide sense stationary, white Gaussian noise. Although this assumption is known not to be correct in the sense that other signal components are also present in the input signal to the junction 102, the decimation carried out by the decimation blocks 152-0 to 152-(M−1) causes aliasing in the other signal components such that the noise in the subsequences is approximately white. The purpose of each of the subsequence estimation blocks 154-0 to 154-(M−1) is then to estimate a constant subsequence estimate $\hat{q}_i(n)$ from the noise-corrupted constant subsequence $x_i(n)$.

Because the input signal x(k) corresponds not to the filtered analog signal provided to the summing junction 102, but rather to the signal produced by subtracting the analog estimated interference signal therefrom, the subsequence estimation blocks 154-0 to 154-(M−1) must form the subsequence estimates $\hat{q}_i(n)$ recursively. For example, the processing performed by each of the subsequencing estimation blocks may be according to the formula $\hat{q}_i(n+1)=\hat{q}(n)+\alpha_i\cdot x_i(n)$, where $\alpha_i$ is a parameter which controls the bandwidth (as well as the tracking speed or time constant) of the estimator. Preferably each of the estimation blocks operates in the same manner as the others, with $\alpha_i$ equal to the same value, say 0.01, for all of the subsequence estimators.

The feedback loop which includes the subharmonic estimator 130 and the summing junction 102 functions as a comb notch filter that attenuates an interference component corresponding to intermodulation of $F_p$ and $F_o$, as well as harmonics of $F_p$ and $F_o$. For the case where $F_p$=60 Hz, $F_o$=73.125 Hz and $F_{sample}$=18.72 kHz, then $F_{subharmonic}$= 1.875 Hz, and M=9984.

To improve the performance of the subharmonic estimator 130 in cases where the input signal is perturbed by impulsive noise, or by the presence of EAS markers or objects which mimic EAS markers (such as shopping carts), inhibit signals indicative of these circumstances are generated by processes to be described below, and in response to the inhibit signals, the subsequence estimators 154-0 to 154-(M−1) are inhibited from updating the subsequence estimate signals $\hat{q}_i(n)$. As a result, the periodic digital estimate signal, $\hat{q}(k)$ is essentially frozen during times when any of the inhibit signals is asserted.

Hybrid AGC Loop

Because the hybrid subharmonic cancellation loop implemented with the estimator 130 and the summing junction 102 substantially attenuates intermodulation interference and other interference components, the signal-to-noise ratio of the signal presented for digitization at A/D converter 126 is substantially improved, and it is possible to boost the level of the signal before digitization, thereby reducing the relative level of quantization noise that results from digitization. For that purpose a hybrid gain control loop is implemented by means of AGC block 132 within the DSP circuit 108, which drives the variable amplifier block 124 within the codec 106.

The AGC processing carried out at block 132 will now be described with reference to FIG. 6.

Figure 6:
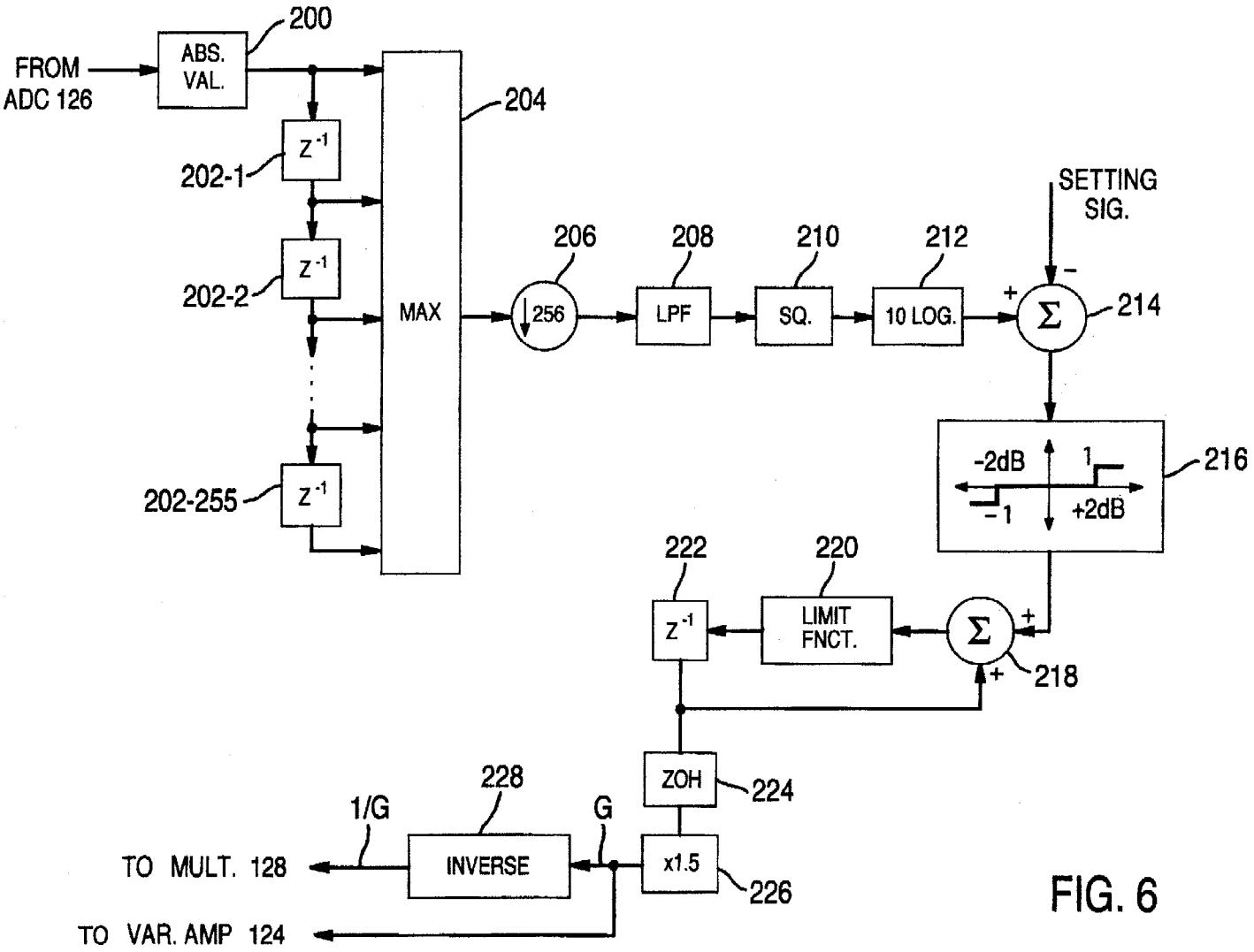
FIG. 6 illustrates in functional block form signal processing carried out by the DSP circuit of FIGS. 2 and 3 for the purpose of automatic gain control.

As seen from FIG. 6, absolute values of the sequence of digital signals output from the analog-digital converter 126 (FIG. 3) are obtained at an absolute value block 200. The resulting absolute value signals are input to a cascade connection of delay elements 202-1 to 202-255. The absolute value signals are also provided to a maximum value block 204, along with signals tapped at the outputs of the delay elements 202. The maximum value block 204 provides as its output the maximum of the signals provided thereto as inputs. The signal output from the maximum value block 204 is then down-sampled at a decimation block 206. The number of delay elements 202 and the degree of down-sampling performed at the decimation block 206 correspond to the number of samples making up a cycle or "frame" of the system transmitter signal (i.e., the interrogation signal). For the preferred transmitter frequency of 73.125 Hz, and the preferred sampling rate of 18.72 kHz, the number of samples per signal cycle is 256. It will be recognized that the result of the processing carried out in blocks 200 to 206 is to obtain the maximum value of the output of multiplication block 128 for each cycle of the transmitter signal. The sequence of maximum value signals is then subjected to digital low pass filtering at block 208 and the filtered value is then squared at block 210. At a block 212, a 10×log function is applied, and then a gain level setting signal is subtracted from the signal output from the block 212 at a summation block 214. In a preferred embodiment of the invention, the set point is $10\times\log_{10}(16{,}384)^2$, in order to make use of the full dynamic range of the A/D converter 126 of codec 106 (FIG. 3).

Continuing to refer to FIG. 6, the output from the summation block 214 is provided as an input to a window function block 216. The output from the window function block 216 is 0 if the signal output from block 214 indicates that the maximum value (represented by the signal output from block 212) is within 2 dB of the setting signal. If the maximum value is below the setting signal by more than 2 dB, then the output of the window block 216 is −1. If the maximum value is above the setting signal by more than 2 dB, then the output of the window function block 216 is −1. The signal output from the window function block 216 is accumulated in an integrator formed of a summation block 218, a limit function block 220 and a delay element 222. The limit function block 220 constrains the output of the integrator to be an integer that is greater than or equal to zero and less than or equal to 15. The integrator output, represented by the output of delay element 222, is then zero-order held at a ZOH block 224, and the result is scaled by a factor of 1.5 at a block 226. As a result, the AGC loop has a gain range of 0–22.5 dB. The output from the scaling block 226 is fed directly to variable amplifier 124 (FIG. 3). The output from the scaling block 226 is also inverted at a block 228 and provided as a coefficient applied at multiplication block 128, in order to restore the signal to the level present immediately upstream from the variable amplifier 124.

Power Line Component Cancellation

Figure 7:
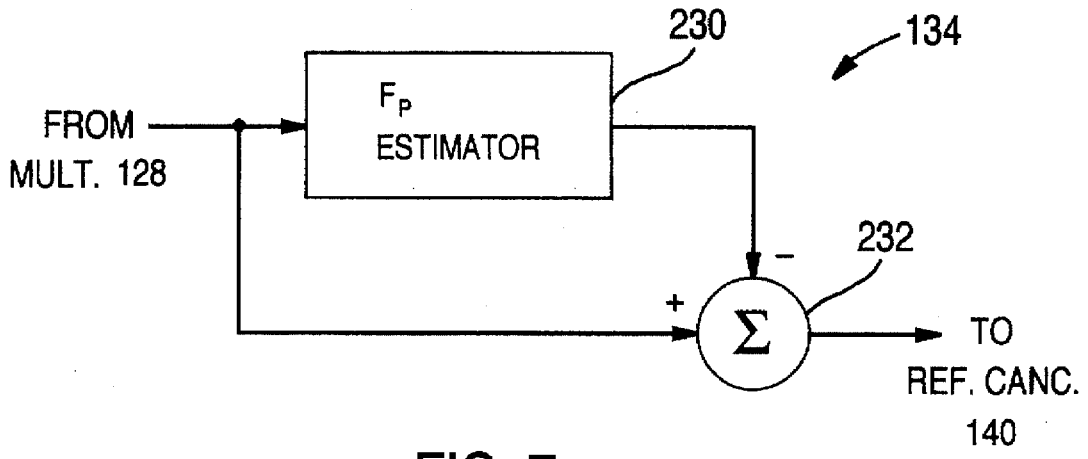
FIG. 7 is a functional block illustration of power line interference cancelling carried out by the DSP circuit of FIGS. 2 and 3.

There will now be described operation of the block 134 (FIG. 3) which provides additional attenuation of an interference component which corresponds to harmonics of the power line frequency $F_p$. As shown in FIG. 7, the processing performed by the $F_p$ canceller 134 includes estimation of the $F_p$ interference component (the estimation process being represented by block 230 in FIG. 7), and subtracting the estimated interference component from the input signal, as indicated at block 232.

The processing performed in the $F_p$ estimator block 230 is of the same general type described above in connection with the subharmonic estimator 130 and illustrated in FIG. 4. As in the subharmonic estimator, the $F_p$ estimator 230 receives the signal formed at the multiplication block 128 as its input signal x(k) and forms M subsequences from the input signal. A subsequence estimate signal $\hat{q}_i(n)$ is formed by processing each of the subsequences $x_i(n)$. The subsequence estimates are then M-fold upsampled and the upsampled subsequence estimates are combined to produce an interference component estimate signal $\hat{q}(k)$. A difference between the $F_p$ estimator 230 and the subharmonic estimator 130 lies in the number of subsequences formed. For the $F_p$ estimator, the number of subsequences M is preferably 312, which corresponds to the number of samples produced during each cycle of the 60 Hz power line signal. Each of the subsequence estimates $\hat{q}_i(n)$ is preferably an estimate of the mean of the corresponding sequence $x_i(n)$, and the process for arriving at this estimate need not be recursive, since the input signal is received directly (and not downstream from the point at which the component cancellation takes place, as was true for the subharmonic cancellation loop). In a preferred implementation of the $F_p$ estimator 230, each subsequence estimator takes the form of a low pass IIR filter having the transfer function $$H_i(z)=\frac{\alpha}{1-(1-\alpha)z^{-1}}$$

As before, the parameter α sets the bandwidth for the filter. Preferably, this parameter may be set by a system operator via the user interface 112 (FIG. 2). The parameter α may, for example, be adjustable in a range $0\leqq\alpha\leqq0.5$, and a typical value for α may be 0.01. Other techniques for estimating the subsequence means may be employed, including, for example, FIR filtering. Using the above-described IIR subsequence estimators and a small value of α such as 0.01, the $F_p$ canceller functions as a comb notch filter with narrow stop bands at harmonics of 60 Hz. Since the input signal is not particularly sensitive to the types of disturbance discussed above in connection with the subharmonic estimator 130, selective inhibiting of the subsequence estimators of the $F_p$ canceller is not required.

Referenced-Based Noise Cancellation

The digital signal output from the $F_p$ canceller block 134 is, as noted above, subjected to reference-signal based cancelling at block 140. Cancellation of a noise component from an input signal on the basis of a "reference" input which contains noise correlated with the noise in the input signal is a known technique described, for example, in Widrow, et al. "Adaptive Noise Cancelling: Principles and Applications", *Proceedings of the IEEE*, vol. 63, no. 12, December 1975, pp. 1692–1716. Selection of one of the conventional approaches for reference-based noise cancellation is within the abilities of those who are skilled in the art, and further description of the reference canceller block 140 will therefore be omitted.

Transmitter Signal Component Cancellation

Figure 8:
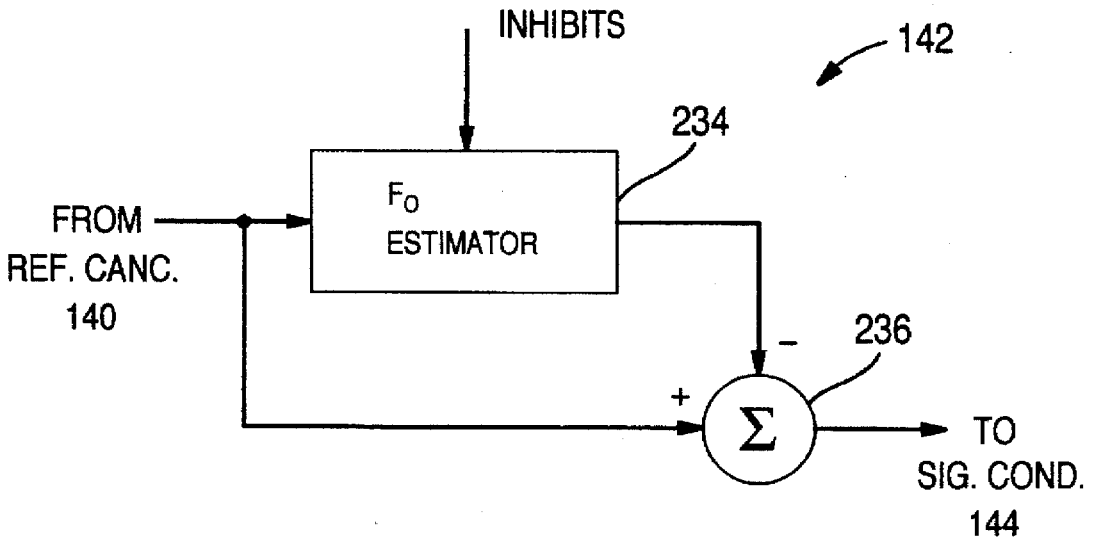
FIG. 8 is a functional block illustration of transmit signal interference cancelling carried out by the DSP circuit of FIGS. 2 and 3.

The signal obtained at the output of the reference canceller block 140 is provided as an input to the $F_o$ canceller block 142. The $F_o$ canceller 142 is illustrated in FIG. 8, and is similar in many respects to the $F_p$ canceller described above. As seen from FIG. 8, the $F_o$ canceller 142 includes processes for estimating an interference component corresponding to harmonics of the system transmitter frequency $F_o$, which estimation is represented by a block 234, and then subtracting the estimated component from the input signal, as represented by block 236.

Figure 10:
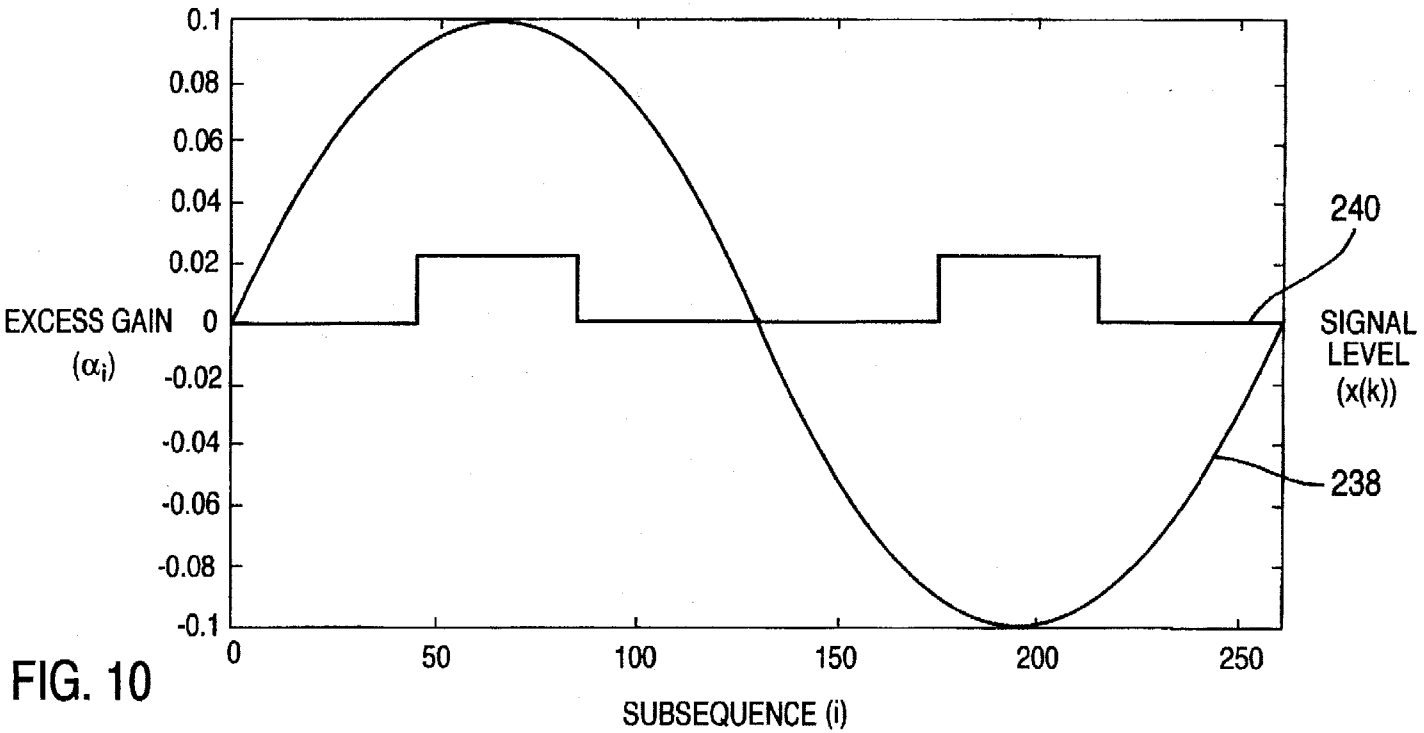
FIG. 10 graphically illustrates subsequence-dependent gain factors employed in subsequence estimation performed by the DSP circuit in connection with transmit signal interference cancellation.

The $F_o$ estimator 234 performs processes similar to those described in connection with the $F_p$ estimator, albeit with respect to a different number of subsequences. Specifically, in a preferred embodiment of the invention, the $F_o$ estimator forms and processes 256 subsequences (i.e., M=256). Again a signal $\hat{q}_i(n)$ representing an estimate of the mean of the respective subsequence $x_i(n)$ is formed for each subsequence, and the techniques for estimating each subsequence mean may be the same as those described in connection with the $F_p$ estimator. However, it is preferred in the $F_o$ estimator to use subsequence estimators that differ from subsequence to subsequence in order to provide faster response in the higher energy subsequences. Accordingly, the preferred subsequence estimator has the form $$\hat{q}_i(n+1)=(1-\alpha_i-\alpha)\cdot\hat{q}_i(n)+(\alpha_i+\alpha)\cdot x_i(n),$$

where $\alpha$ is a gain parameter used in all of the subsequence estimators, but $\alpha_i$, known as the "excess gain profile", varies among the subsequence estimators. As before, $\alpha$ is preferably user programmable, and $\alpha_i$ equals a value such as 0.025 for the highest energy subsequences (those close the crests of the transmit signal cycle), and $\alpha_i=0$ for the other subsequences. The relationship among the excess gain profile $\alpha_i$, the subsequences, and the transmit signal cycle is schematically illustrated in FIG. 10. As shown in FIG. 10, trace 238 is indicative of the input signal level while trace 240 indicates the value of the excess gain parameter $\alpha_i$.

As in the case of the subharmonic estimator 130, the $F_o$ estimator 234 is selectively provided with inhibit signals. When any one of the inhibit signals is asserted, the gain parameter $\alpha$ is set to 0 for each of the subsequence estimators, thereby "freezing" (i.e., inhibiting updating by), or increasing the response time of, each of the subsequence estimators.

Backup Estimators for $F_o$ Canceller

In a preferred embodiment of the invention, even when the estimator 234 (FIG. 8) is inhibited from updating the estimate of the $F_o$ interference component which is supplied to the subtraction block 236, a backup estimation process continues to operate. The backup estimation process operates in the same manner as the estimator 234, except that the backup estimator operates on the signal output from the subtraction block 236, and the backup estimator is not subject to having its operation interrupted by inhibit signals. If the estimator 234 is inhibited from updating its estimate for more than a predetermined period of time, then the estimate signal output from the backup estimator is added to the "frozen" estimate provided by the estimator 234 so as to provide an "instantaneous" update of the $F_o$ interference component. The resulting updated estimate is then provided for subtraction at subtraction block 236 from the signal that is input to the $F_o$ estimator 142.

It is also contemplated to provide two backup estimation processes in the $F_o$ canceller 142 and to "toggle" back and forth between the two backup estimators, so that, while one backup estimator continuously updates its estimate of the residual interference component, the other backup estimator's estimate of that component is "frozen". When the predetermined time period expires, and the first backup estimator is used to update the primary estimator, then the output of the first backup is frozen, and the second backup is operated as the active backup. In this way, the selective updating of the estimate can occur, while also preserving information regarding the previous residual interference component estimate.

Digital Signal Conditioning

Referring again to FIG. 3, the signal output from the $F_o$ canceller block 142, which has had an interference component corresponding to the system operating frequency attenuated, is provided to the digital signal conditioning block 144 at which further filtering is carried out. For example, in a preferred embodiment of the invention, the block 144 includes in cascade three programmable single tone notch filters, a comb median filter, and a linear comb bandpass filter.

The three programmable single tone filters are available to remove single tone interference that may be present in the interrogation zone because of, for example, nearby installation of other types of EAS systems.

The comb median filter is an invention of two of the applicants of the present application and is described in co-pending patent application Ser. No. 08/635,697, filed on Apr. 22, 1996. Briefly, comb median filtering is accomplished by performing a polyphase decomposition of an input signal, applying median filtering to each of the resulting subsequences, and synthesizing the filtered subsequences to form an output signal having the same sampling rate as the input signal. The number of subsequences formed in the comb median filter is preferably the same as the number of subsequences formed in the $F_o$ canceller described above. The median filtering of the subsequences is preferably performed using a window of three or five samples. The comb median filter is provided to remove impulsive noise that would, if not removed, tend to cause ringing in the downstream linear comb bandpass filter.

The linear comb bandpass filter is a known process for attenuating interference between the frequencies which are characteristic of the marker signal to be detected. The passbands of the linear comb bandpass filter are chosen to correspond to harmonics of the system transmitter frequency $F_o$.

In a preferred embodiment of the invention, the comb median filter and the linear comb bandpass filter are user-selectable features that are not operated unless the system is installed in an unusually noisy environment. It is preferred to avoid use of these two comb filters because the comb-filtering tends to "smear" marker signals that jitter in phase relative to the interrogation signal cycle. This phenomenon and a technique for ameliorating its effects will be discussed in the next section.

Marker Signal Detection and Estimator Inhibits

The filtered signal output from conditioning block 144 is provided for marker detection processing to block 146. In the processing of block 146, certain processing algorithms are performed to provide a statistic indicative of the likelihood that a marker signal is present in the interrogation zone.

As will be seen, when the processing in block 146 results in a determination that a marker of the type to be detected by the system is present in the interrogation zone, the subharmonic estimator 130 and the $F_o$ estimator 234 of the $F_o$ canceler 142 are inhibited.

The processing in block 146 also detects other conditions during which the estimators 130 and 234 are to be inhibited.

Figure 11:
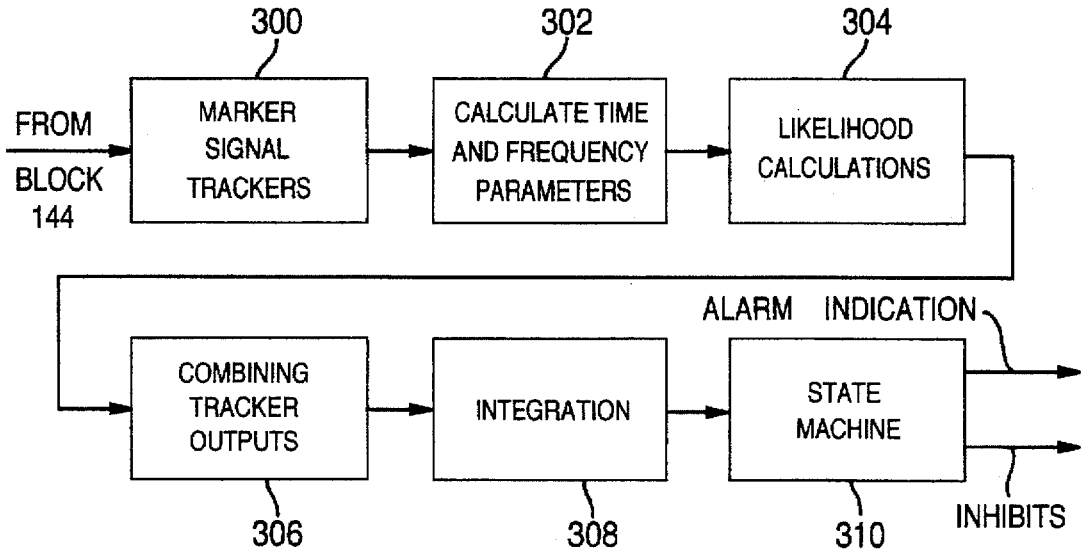
FIG. 11 represents as functional blocks major portions of a marker detection algorithm performed by the DSP circuit.

The processing carried out in block 146 will now be summarized, initially with reference to FIG. 11.

It will be assumed for the purposes of further discussion that the EAS system described herein is intended to be used with harmonic EAS makers of the type described in the above-referenced U.S. Pat. No. 4,660,025. Markers of this type will sometimes hereinafter be referred to as "J tags". A primary function to be performed by the marker detection processing is to detect the presence of such markers in the interrogation zone, and to output signals that actuate an alarm condition and inhibit updating of the subharmonic estimator 130 and $F_o$ estimator 234. It will also be assumed that harmonic markers of a different type, for example including an active element formed of permalloy, will sometimes be brought into the interrogation zone. Markers of the second type also produce harmonic perturbations of the interrogation signal, but have a substantially higher output signal level, on average, than the J tags. It is desired that markers of the second type also be detected, but only for the purpose of inhibiting updating of the estimators 130 and 234 and not to actuate an alarm. Markers of the second type will hereinafter be referred to as "P tags".

Finally, the detection processing should detect the presence of a shopping cart or other metal object that produces a rather high-amplitude harmonic signal, so that, again, the estimators 130 and 234 can be inhibited from updating interference component estimates when such objects are present in the interrogation zone.

The steps making up the detection processing block 146 are illustrated in summary form in FIG. 11, and include tracking marker signals (block 300), calculating time domain and frequency domain parameters (block 302) from the waveforms of the signals tracked at block 300, calculating likelihood statistics (block 304) from the time domain and frequency domain parameters, establishing final likelihood statistics (block 306) on the basis of the likelihood statistics calculated for a number of candidate marker signals, integrating the final likelihood statistics over time (block 308), and operating a state machine (block 310) on the basis of the integrated likelihood statistics to selectively output an alarm actuation signal, and to generate inhibit signals applied to the subharmonic estimator 130 and the $F_o$ estimator 234.

In the marker signal tracking block 300, a plurality of signal features are tracked simultaneously for the purpose of determining whether each feature is a marker signal. In a preferred embodiment, up to four features, if qualified, are tracked. To qualify for tracking, a signal feature must have a peak value that is above a threshold, and is not too close in phase to another feature that is being tracked. Preferably, the threshold is updated for each signal frame, which is a set of data points corresponding to a cycle of the system interrogation signal.

Figure 15:
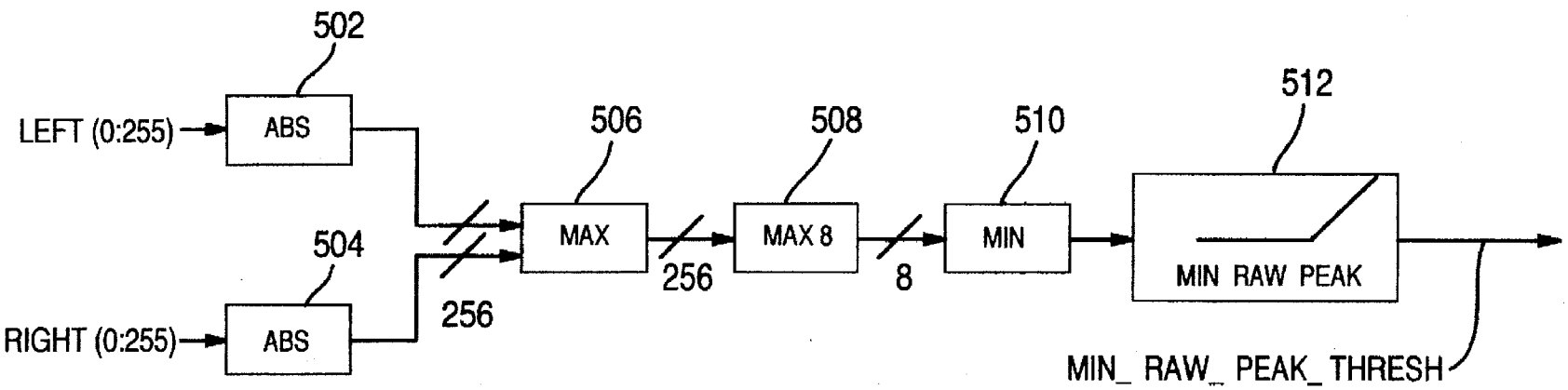
FIG. 15 schematically illustrates processing for generating a threshold used to identify candidate marker signals as part of the marker detection algorithm of FIG.. 11.

An algorithm for setting the threshold is schematically illustrated in FIG. 15. As indicated at blocks 502, 504 and 506, for each sample period the absolute values of the left and right channels are compared and the larger of the two is selected. Of the selected 256 samples for each signal frame, the eight largest that are not within a window around a larger value are found (block 508), and the smallest of the eight values is compared with a predetermined minimum threshold (blocks 510 and 512). The larger of the predetermined minimum threshold and the eighth largest value is selected as the threshold to be used in qualifying signal candidates. In a preferred embodiment, the minimum threshold can be selected by the user. A suitable default value for the minimum threshold is 25 mV.

When a marker is present, there is usually one marker signal (sometimes called a "switch") in each half of the signal frame. By tracking up to four marker signal candidates in each frame, it is possible to maintain tracking of both switches, even though there are as many as two noise spikes present in the frame.

Figure 12:
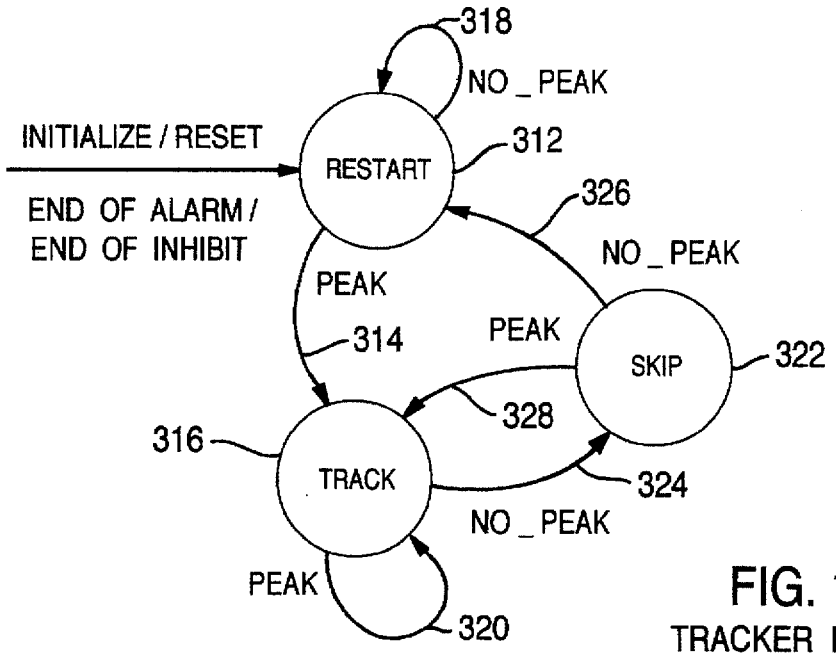
FIG. 12 is a state diagram of a marker signal tracking function implemented on the DSP circuit.

Each of the four marker signal tracking functions operates in one of three modes, which are "restart", "track" and "skip". A state diagram which illustrates the relationships among these modes is presented in FIG. 12.

All four of the tracking functions enter the restart mode 312 when the EAS system is initialized or reset, or when an alarm condition or an inhibit condition is terminated. When all four of the tracking functions are simultaneously restarted, the four highest peaks that are above the minimum threshold and are sufficiently distant from each other are tracked. When a qualified signal candidate (i.e., a qualified peak) is available for a tracker in the restart mode, the tracker transitions, as indicated at 314, to the tracking mode 316. To be a qualified candidate, the signal peak must be above the adaptive threshold and within a predetermined phase window for two successive frames. If there is no qualified peak, the tracker remains in the restart mode, as indicated at 318, and proceeds to consider for tracking the highest remaining peak value not within a given phase distance with peaks already being tracked.

When a tracker is in the track mode 316, the same candidate signal continues to be tracked so long as it is above the adaptive threshold and inside a phase window, as indicated at 320. If the candidate signal being tracked is missing for one frame, the tracker transitions to the skip mode 322 as indicated at path 324. In the skip mode 322 the statistics for the signal being tracked are maintained without change from the previous signal frame. If the signal being tracked is absent for a second frame, the tracker transitions to the restart mode 312, as indicated by the path 326. Otherwise, i.e., if the candidate signal returns after only missing one frame, the tracker returns from the skip mode 32 to the track mode 316, as indicated at 328.

Figure 13:
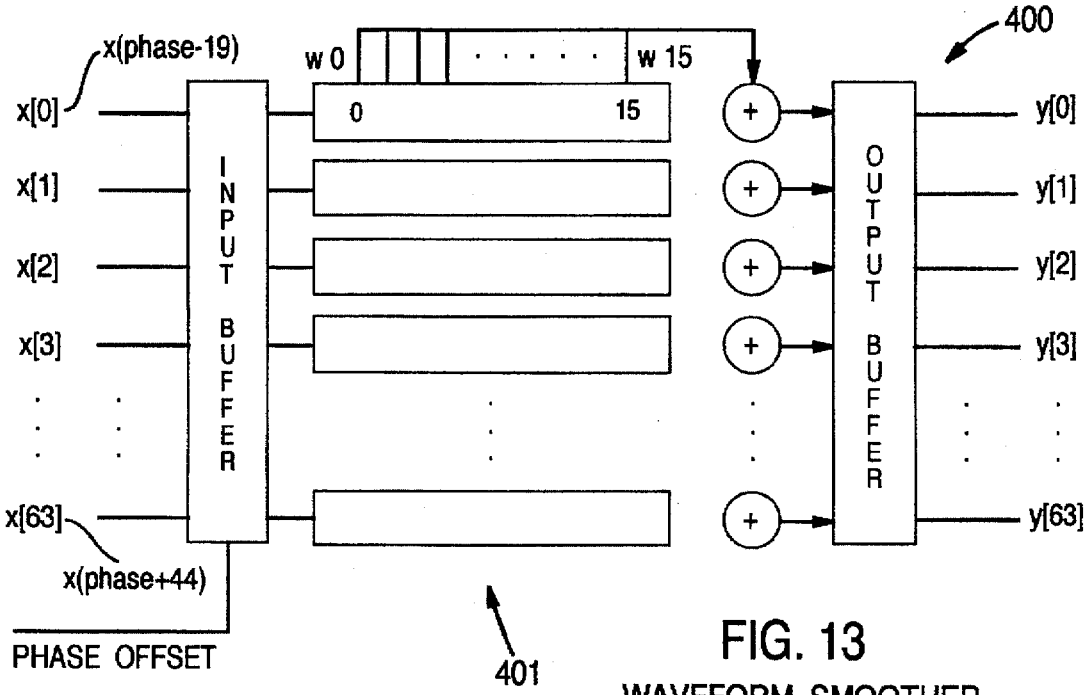
FIG. 13 schematically illustrates a waveform smoothing function carried out as part of the marker signal tracking function.

A primary output provided by each of the tracking functions is a smoothed version of the waveform representing the marker signal candidate tracked by the tracking function. The waveform smoothing function is schematically illustrated in FIG. 13 and is generally indicated by reference numeral 400. As seen from FIG. 13, the smoothing function is a comb band pass filter, implemented on a window of 64 samples and carried out over 16 signal frames. Low pass filtering is performed with respect to each of 64 subsequences.

Figure 16:
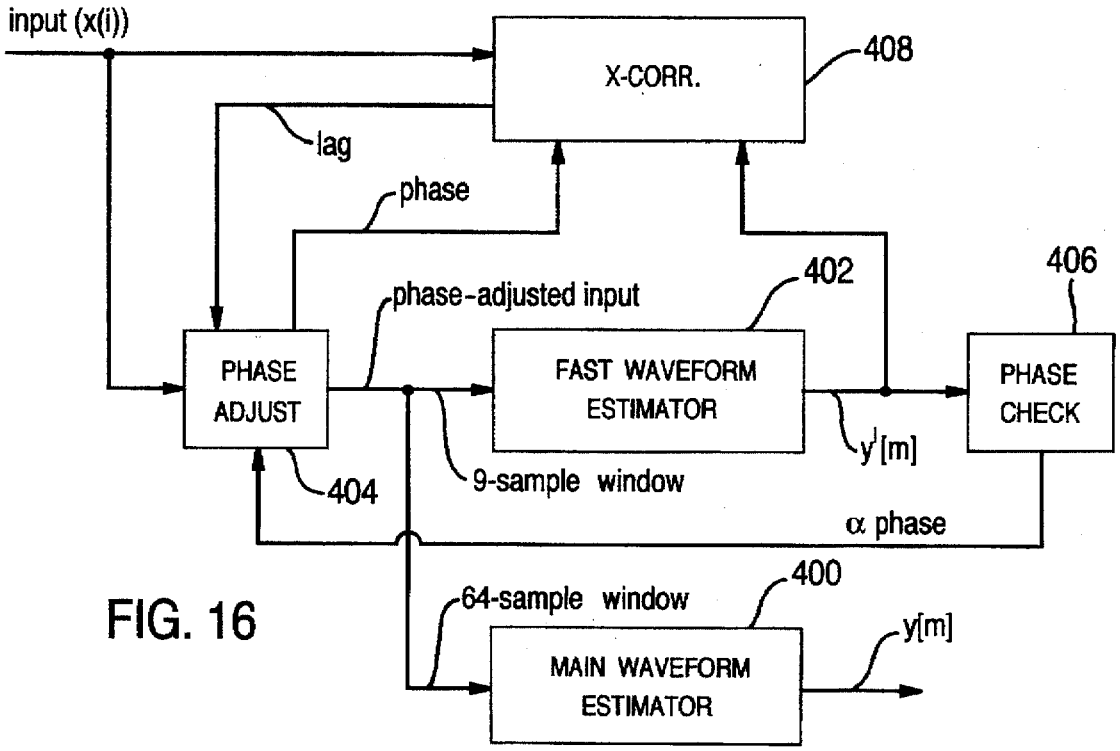
FIG. 16 schematically illustrates phase-adjustment processing applied to input signals for the waveform smoothing function of FIG. 13.

As indicated above, if the phase of the marker signal candidate relative to the interrogation signal cycle changes or "jitters" from signal frame to signal frame (as is often the case), the output of the smoothing function 400 will be such that the peak of the marker signal candidate is substantially attenuated and smeared. FIG. 18(*a*) illustrates an input marker signal candidate which exhibits considerable phase jitter over a number of signal frames, and FIG. 18(*b*) illustrates the resulting smoothed waveform output from the smoothing function 400. It will be seen from FIG. 18(*b*) that the comb-filtering performed by the function 400 has greatly attenuated the peak value of the input signal while also producing a very blurred peak in the output. To compensate for phase-jitter in the marker signal candidate, the timing of the input window for the smoothing function 400 is adjusted relative to the interrogation signal cycle so that the window "tracks" the phase of the marker signal candidate. The phase-adjustment process is schematically illustrated in FIG. 16.

Figure 17:
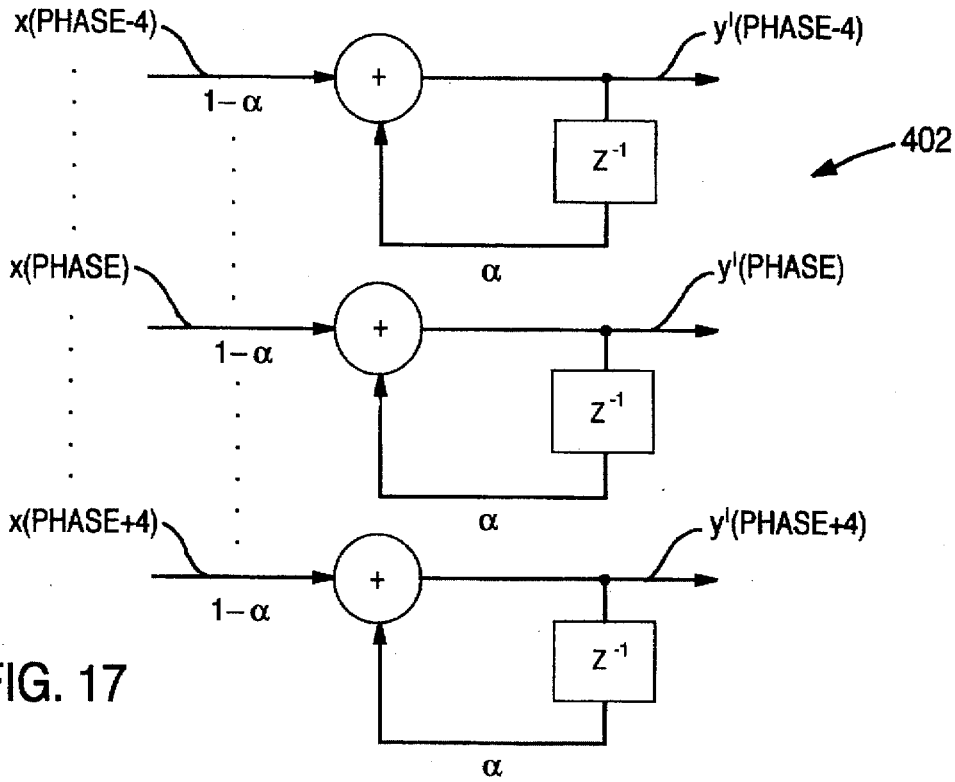
FIG. 17 schematically illustrates a comb-filtering function that is part of the phase-adjustment processing of FIG. 16.
Figure 18A:
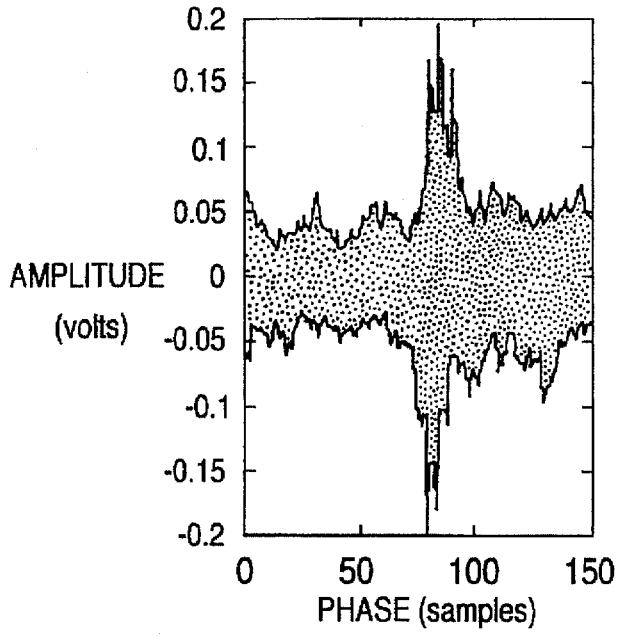
FIGS. 18(*a*) and (*a*) respectively illustrate signal traces of an input signal and an output signal of the waveform smoothing function of FIG. 13, in a case where the input signal is not phase-adjusted.
Figure 18B:
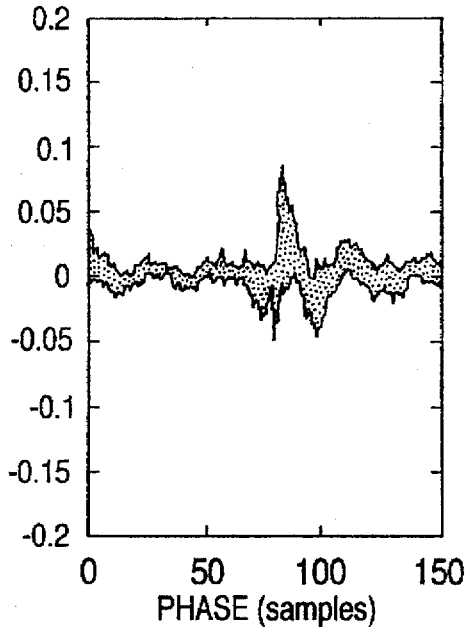
Figure 18C:
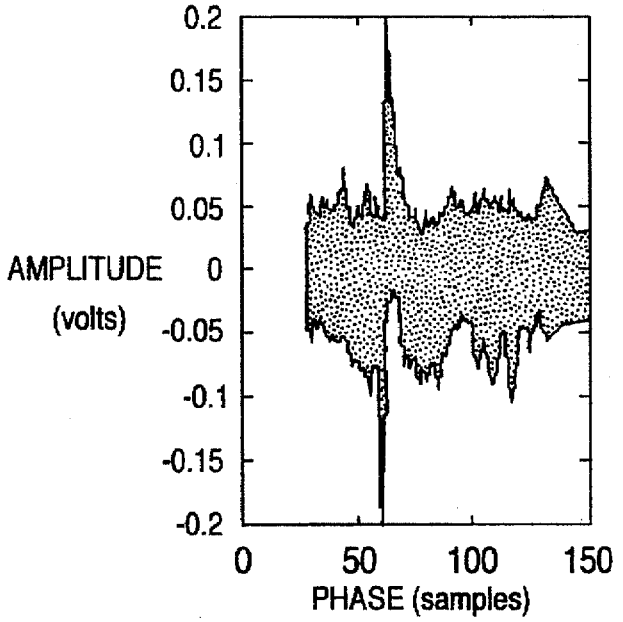
Figure 18D:
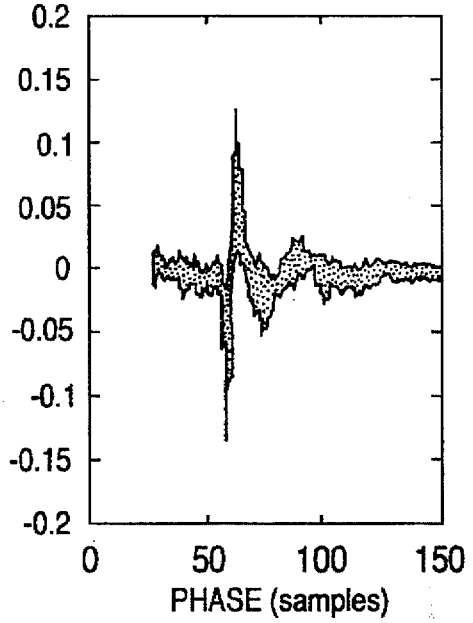

When the marker signal candidate is first identified, the sample corresponding to the peak value is taken to be the phase of the marker signal candidate, and the timing of the input window for the smoothing function 400 is initially set so that the peak sample is the twentieth sample in the window, as indicated in FIG. 13. Thereafter, the timing or phase of the window is adjusted to follow estimated changes in phase of the marker signal candidate. As seen from FIG. 16, the functional processing blocks used in this process, in addition to the smoothing function 400 (referred to as "main waveform estimator" in FIG. 16) are a fast waveform estimator 402, a phase adjustment block 404, a phase checking block 406 and a cross-correlation block 408. The output of the fast waveform estimator 402 is used to provide a rapidly updated estimate of the phase of the marker signal candidate. As seen from FIG. 17, the fast waveform estimator 402 is preferably implemented as a comb filter having a fast time constant and operating with respect to a window of nine samples centered on the estimated phase position of the marker signal candidate. Each of the resulting nine subsequences is recursively filtered according to the formula $$y'[m,n]=\alpha x[m]+(1-\alpha)y'[m,n-1]$$

In a preferred embodiment of the invention, $\alpha$ is taken as 0.1. Initially, the "center tap" of the fast waveform estimator 402 is set at the sample corresponding to the peak of the marker signal candidate. That is, the nine-sample window which selects the input for the fast waveform estimator 402 is positioned in the signal frame so that the fifth sample in the window is x(phase), as seen from FIG. 17.

The cross correlation block 408 operates on the output from the fast waveform estimator 402 and appropriate portions of the input signal (i.e., the current signal frame) according to the following formula:

$$xcorr(l)=\sum_{i=\text{phase}(n)-4}^{\text{phase}(n)+4} x(i-l)y'(i)$$

where the parameter 1 is sequentially assigned values in the range −5 to 5 in order to detect changes in the phase of the marker signal candidate. In this formula, phase(n) is the estimate of the phase of the marker signal candidate as used for the input windows of the estimators 400 and 402 in the present signal cycle, x( ) is an input signal (a sample from the present signal frame) y'( ) is an output provided by one of the subsequence filters of the fast waveform estimator 402, and i is the sample index. Whichever value of 1 corresponds to the maximum value of xcorr(1) is provided as the output lag(n) of the cross correlation block 408 and is an input to the phase adjustment block 404. An additional input for the phase adjustment block 404 is provided by the phase checking block 406. The phase checking block 406 operates on the estimated waveform output from the fast waveform estimator 402 and is provided to cope with changes in the shape of the waveform of the marker signal candidate. The phase checking block 406 determines whether the peak of the waveform estimate output from the fast estimator 402 is in a position other than the fifth sample. If so, it is next determined in the phase checking block 406 whether the magnitude of the peak is more than 6 dB greater than the amplitude of the fifth sample, in which case five is subtracted from the index of the peak sample to produce the output dphase(n) of the phase checking block 406. The resulting output dphase(n) is provided as an input to the phase adjustment block 404. At the phase adjustment block 404, the estimate of the phase of the marker signal candidate to be used in the next signal frame is provided according to the following formula:

$$\text{phase}(n+1)=\text{phase}(n)+\text{lag}(n)+\text{dphase}(n)$$

The updated estimated phase is then used to "steer" the input windows for both the estimators 400 and 402. In particular, the timing of the input window for the waveform smoother 400 is adjusted so that in the signal frame n+1, the main peak at phase(n+1) is lined up with its corresponding sample for the previous frame. With respect to the fast estimator 402, the input window is adjusted so that the fifth sample in the window corresponds to phase(n+1).

FIG. 18(*c*) illustrates the effect on the input signal of FIG. 18(*a*) of the above-described adjustment in the timing of the input window for the waveform smoother 400. The resulting filtered output signal from the smoother 400 is shown in FIG. 18(*d*). A comparison of the filtered output signal shown in FIG. 18(*d*) with the signals shown in FIG. 18(*b*) indicates that phase-adjusting the input signal results in an output signal which is much sharper, and in which the peak value of the input signal has suffered less attenuation.

The smoothed estimate of the marker signal candidate waveform output from the waveform smoother 400 is processed at block 302 of FIG. 11 to generate both time and frequency domain parameters. Smoothed estimate waveforms corresponding to input signals from both right-side and left-side receive antenna channels are used.

Frequency domain parameters are generated so as to be suitable for use as inputs to a neural network processing algorithm. Techniques for generating frequency-domain parameter inputs for neural network marker detection processing are described in U.S. Pat. No. 5,537,094, issued Jul. 16, 1996, which has common inventors and a common assignee with the present application, and is entitled, "Method and Apparatus for Detecting an EAS Marker Using a Neural Network Processing Device." The disclosure of the U.S. Pat. No. 5,537,094 is incorporated herein by reference, but certain details concerning frequency domain parameterization, as carried out in a preferred embodiment of the invention, will now be described.

Initially, a windowing process is applied to the 64-sample-long estimated waveform provided for each of the left and right channels. An asymmetrical window is used in which the first eight samples are constituted in accordance with the first half of a 16 sample Blackman-Harris window, followed by the next 24 samples as outputted from the waveform smoother. The final 32 samples of the window are formed as the second half of a 64-sample Blackman-Harris window. This window is matched for a typical marker signal in which the peak appears in the first half of the window and a natural response rolls off toward the end. The window operates to reduce any sharp edges that may be present at the beginning or end of the wave form.

After windowing, the right and left channel signals, although both real sequences, are treated as a single complex sequence and subjected to a complex fast Fourier transform (FFT) and the resulting coefficient data is then separated back into the respective coefficient sets for the left and right sequences. A power spectrum is calculated for each of the left and right channels, and then the resulting power spectrum statistics for the channels are summed together. Then frequency bins that are each about 1 kHz wide are formed by summing three adjacent coefficients together, to form seven frequency channel statistics which cover the range of 0 to about 7 kHz. The higher frequency coefficients, not used to form the seven channel statistics, are discarded. The first and third through seventh channel statistics are then respectively divided by the statistic for the second channel (corresponding approximately to the frequency range 1–2 kHz), and square roots of the respective ratios are taken to produce six frequency domain parameters ready for input to the neural network.

The time domain parameters calculated at block 302 relate to the phase of the marker signal candidate relative to the transmit signal cycle, the phase velocity of the marker signal candidate, the absolute value of the phase velocity, the power of the candidate signal waveform, the correlation of the input candidate signal with the signal as tracked in previous signal cycles, absolute magnitude, energy, and wave shape, including pulse width and pulse shape.

The phase of the marker signal candidate is determined as discussed above, and is measured in samples.

The velocity is a function of changes in the phase from cycle to cycle. The velocity parameter provided at box 302 is an average of the changes in phase over a number of cycles and is measured in samples per cycle.

The absolute value of velocity parameter is calculated by disregarding the sign (direction) of the change of phase, and similarly is averaged over a number of cycles and measured in samples per cycle.

The correlation coefficient is calculated on the basis of the signal provided as an input to the waveform smoother function of FIG. 13, and the smoothed output provided by the waveform smoother function.

The pulse width portion of the wave shape factor is calculated by summing the respective samples for the left and right channels for each of the 64 sample positions in the output signal and then determining the distance between the zero crossings on either side of the main peak of the resulting summed samples. The pulse shape statistic determines whether the main peak is followed by an excessively large secondary peak.

A satisfactory pulse width is taken to be greater than three samples and less than fourteen samples while a satisfactory pulse shape is present if the highest peak found later than 20 samples after the main peak is no more than 0.75 times the amplitude of the main peak value. A "1" value is assigned to the wave shape factor only if both the pulse width and the pulse shape characteristics are satisfied.

The likelihood calculations of block 304 are performed by applying neural network processing to the frequency domain parameters which were calculated as indicated above. The neural network processing is performed, in a preferred embodiment of the invention, using a three layer perceptron, as described in the above-referenced U.S. Pat. No. 5,537,094. The neural network, prior to operation on "live" data, is trained using data collected from J tags, P tags and data collected in the absence of either tag. The output of the neural networking process consists of two statistics, a likelihood factor for the presence of a J tag and a likelihood factor for the presence of a P tag. Both of likelihood factors are in a range from 0 to 1.

Another likelihood factor calculated at block 304 is referred to as "TIME_LF". TIME_LF is assigned a value "1" only if each of six time-domain related parameters satisfy respective qualifying criteria; otherwise TIME_LF is assigned a value "0" For TIME_LF to have the value "1": (a) the phase parameter must be within a predetermined window within the transmit signal cycle; (b) the velocity parameter must be less than a predetermined value; (c) the power of the switch candidate waveform must be above the background noise level by a predetermined factor (e.g., 9 dB); (d) the absolute value velocity figure, after adjustment based on the power level of the waveform, must be less than a predetermined threshold; (e) the wave shape factor must have the value "1" and (f) the correlation coefficient parameter must exceed a predetermined threshold.

In addition to the neural network processing of the frequency domain parameters, there is also neural network processing of the signal amplitude and energy parameters gathered in the time domain. In a preferred embodiment of the invention, four separate multi-layer perceptrons (MLPs) are employed to determine whether the energy and amplitude parameters are indicative of the presence of a J tag or a P tag. The parameters are taken with respect to both the left and right side receiving antennas. For a J tag, if the tag is about halfway between the antennas, a relatively low signal energy and amplitude will be present in both channels. If the J tag is close to one antenna, then a rather high level is provided in that channel and a low level in the other channel. If a relatively high energy or amplitude is present in both channels, then a J tag cannot be present. Thus, the MLPs for the J tag determine respectively whether the energy and amplitude parameters are such as can be provided by a J tag. Each of the two MLPs for the J tag produces either a "1" output indicating respectively that the amplitude and energy of the signal are in the tag region, or a "zero" output otherwise. The P tag region has the same shape as the J tag region, but with a higher signal level being permissible for both amplitude and energy. As before, the MLPs for the P tag output either "1" or "0". If the signal channel outputs are such that both left and right channel signals are relatively high, so that neither a J nor a P tag could have generated the signal, then some other metallic object, such as a shopping cart, is probably present in the interrogation zone.

For each of the marker signal candidates tracked by the four switch trackers there are four outputs: J_PROB, P_PROB, SWITCH_LF and PHASE.

The J_PROB output for a switch tracker is equal to the J tag likelihood factor output by the frequency domain neural network processing, except that J_PROB is set to zero if either TIME_LF is zero, or the output of either time domain parameter MLP for the J tag (i.e., for the power or amplitude) is zero.

Similarly, P_PROB is set to zero if TIME_LF is zero or either one of the MLPs for the P tag outputs a "0" Otherwise, P_PROB is equal to the P tag likelihood factor output from the frequency domain neural network processing, but augmented with the value of the J tag likelihood factor output from the frequency domain neural network processing in the event that either of the MLPs for the J tag outputs a zero. (In the latter circumstance, it can be assumed that the frequency domain neural network outputs were indicative of the presence of a J tag and the absence of a P tag and the result of the augmentation will be the correct indication that a P tag is present.)

The output SWITCH_LF is calculated as the weighted sum of the parameters J_PROB, TIME_LF and other factors. Specifically, the weights applied to J_PROB and TIME_LF are each 0.25. In addition, 0.05 is added to the sum in each case where the above described velocity, absolute value velocity, and power level qualifying condition were satisfied. Further, if the energy of the estimated waveform provided by the waveform smoother exceeds the background power level by a predetermined margin (e.g., 18 dB), 0.1 is added to the weighted sum. Also, a phase factor in the range from 0 to 0.1 is added to the weighted sum, with a greater weight being accorded switch candidate signals that are closer to the zero crossing of the transmit signal cycle. It will be noted that when TIME_LF is zero J_PROB is also zero. However, some of the other factors may be non-zero and may cause the value of SWITCH_LF to be output at a low but non-zero level. In general, the range of SWITCH_LF is from 0 to 1.0.

The PHASE output simply represents where the marker signal candidate falls relative to the transmit signal cycle.

After all four outputs have been calculated for the four marker signal candidates tracked by the tracker functions, an algorithm represented by block 306 in FIG.. 11 is carried out to provide final J tag and P tag likelihood statistics for the data frame. As a first step of the algorithm, each marker signal candidate is paired with itself and each of the other marker signal candidates, producing a total of ten pairs in all. Then, for each pair, a switch-pair likelihood factor is calculated according to the following criteria: If the paired switches are different from each other (not a same-switch pair), the switch pair likelihood factor is zero if the two switches differ in phase by less than 90°, and otherwise is one half of the sum of the likelihood factors (SWITCH_LF) of the two different switches. For the same switch pairs, the switch likelihood factor is taken as one half the switch likelihood factor for the switch in question. The resulting switch-pair likelihood values are compared and the pair having the maximum switch likelihood is selected. If the selected pair is not a same-switch pair, the final J_PROB for the signal frame is taken as one half the sum of the respective J_PROB values for the two switches, and the P_PROB for the signal frame is taken as one-half the sum of the respective P_PROB values of the two switches. If a same-switch pair is selected, the signal frame J_PROB and P_PROB values for the frame become, respectively, one half of the corresponding values for the switch that was paired with itself to make the selected switch pair.

The detection processing illustrated in FIG. 11 then proceeds to the integration block 308. The signal frame J_PROB is subjected to a non-linearity and then is integrated over time. The non-linearity outputs a value of 1.31×(J_PROB−0.25) when J_PROB is greater than or equal to 0.25; otherwise the output from the non-linearity is 4×(J_PROB−0.25). The output of the integrator is restricted to the range 0 to 13. The same non-linearity and integration function is also performed with respect to the final P_PROB for the signal frame.

Figure 14:
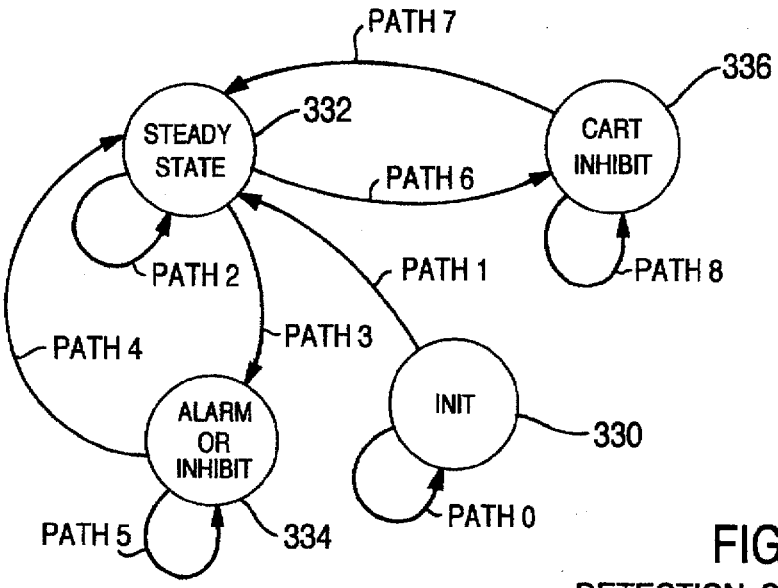
FIG. 14 illustrates a state machine that is a final stage of the marker detection algorithm of FIG. 11.

The outputs from the integration function are used to drive the state machine 310 (FIG. 11). A representation of the state machine is provided in FIG. 14. It will be observed that the state machine includes four states: Initialization (state 330), steady state (state 332), the alarm or inhibit state (state 334) and the shopping cart inhibit state (state 336).

The initialization state 330 is entered when the system is initialized, and is maintained, as indicated by path 0, until initialization is complete. Upon completion of initialization, the steady state 332 is entered as indicated by path 1.

In the steady state 332, the outputs of the integrators for the J tag and the P tag probabilities are compared against respective thresholds. In addition, it is determined whether any of the four marker signal candidate waveforms exhibit a power level that is too large to be the product of a P tag. If none of these events is detected, then the steady state 332 is maintained, as indicated by path 2. However, if either the J tag threshold is exceeded, or the P tag threshold is exceeded, the alarm or inhibit state 324 is entered as indicated by path 3.

In the alarm or inhibit state 324, an inhibit signal is provided to the subharmonic estimator 130 and the $F_o$ estimator 234, as previously mentioned. In addition, if the alarm or inhibit state 324 was entered because the J tag threshold was exceeded, then an alarm indication is output to the indicator 56 (FIG. 2).

So long as the J tag or P tag integrator output remains above the threshold level (as the case may be), and for a predetermined timeout period thereafter, the alarm or inhibit state 324 is maintained, as indicated by path 5. At the end of the timeout period after the integrator output falls below the threshold, the integrators are reset, the inhibit and/or alarm signals are disasserted, and the steady state 332 is re-entered, as indicated by path 4.

Considering again the steady state 332, path 6 is indicative of the transition that occurs if one of the four marker candidate signal power levels is above a level that is characteristic of a P tag. In this case, the cart inhibit state 336 is entered, and the inhibit signal for the subharmonic estimator 130 and the $F_o$ estimator 234 is asserted. If the condition which caused the cart inhibit state 336 to be entered ceases, and does not recur during a timeout period, then the steady state 332 is re-entered, as indicated by path 7. Otherwise, the cart inhibit state 336 is maintained, as shown by path 8. In addition to asserting an inhibit signal, the system may also respond to the cart inhibit state by asserting an indication that a shopping cart is present in the interrogation zone and should be removed.

Inhibiting Estimator Updates

Figure 9:
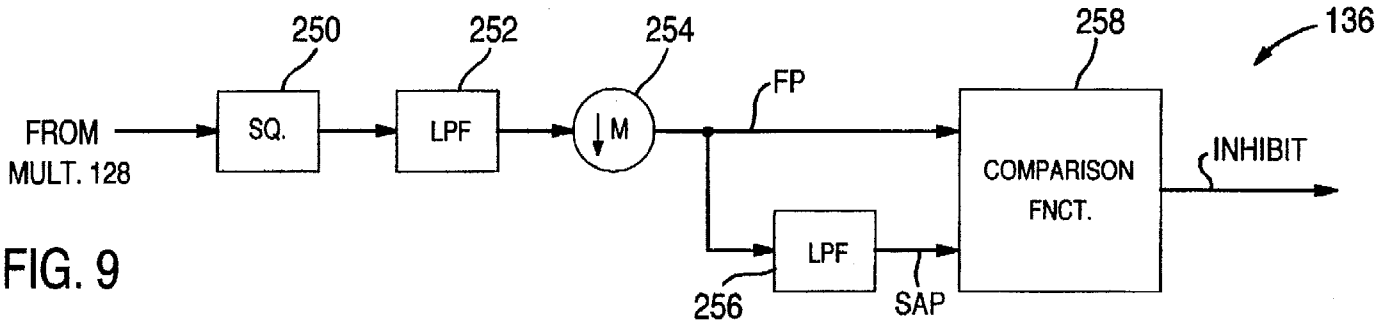
FIG. 9 is a functional block illustration of power level monitoring carried on by the DSP circuit of FIGS. 2 and 3.

As discussed immediately above, the marker detection processing block 146, through state machine 310, selectively provides inhibit signals to inhibit updating of interference signal components by the subharmonic estimator 130 and the $F_o$ interference component estimator 234. An additional source of inhibit signals for the subharmonic estimator 130 and the $F_o$ estimator 234 is the power monitor function block 136 that is implemented through the DSP circuit 108. The process carried on in the power monitor block 136 is schematically illustrated in FIG. 9. As shown in FIG. 9, the digital signal output from the multiplication block 128 is squared (block 250) and then digital low-pass filtered (block 252). The resulting low-pass filtered digital signal is then down-sampled (block 254) by a factor of 256 to provide a signal FP which is a statistic representing the power level for the current frame of the system transmit signal. The signal FP is then low-pass filtered at block 256 to form a slow-averaged power statistic signal SAP. A comparison function block 258 compares the signals FP and SAP, and asserts an inhibit signal when the frame power statistic signal FP differs from the slow-averaged power statistic signal SAP by more than 6 dB. The inhibit signal selectively output from the comparison function block 258 is supplied to both the subharmonic estimator 130 and the $F_o$ estimator 234 to inhibit estimation by those functions of the respective interference components. The effect of the inhibit signal provided by the power monitor block 136 is to prevent impulsive noise from upsetting the operation of the estimators 130 and 234.

Referring again to FIG. 2, another source of inhibit signals for the estimators 130 and 234 is the channel formed by the low pass filter 118, A/D converter 120 and control circuit 122. As shown in FIG. 2, the pre-amplified analog signal produced by the pre-amplifier 38 is taken out upstream from the analog signal conditioning circuit 40 and low-pass filtered at LPF circuit 118, and then converted to a digital signal by A/D converter 120. The resulting digital signal is processed by control circuit 122 to detect changes in the fundamental level of the signal received at the antenna 36. If the fundamental level of the signal increases by more than a predetermined amount, then an inhibit signal is asserted by the control circuit 122.

It should be understood that the estimators 130 and 234 are inhibited upon assertion of any one of the above-described inhibit signals.

With the strategies implemented according to the present invention in terms of signal conditioning, cancellation of interference components, and reduction of quantization noise, the signal presented to the marker detection processing block 146 can be processed so as to detect the presence of an EAS marker in the interrogation zone with greater reliability and/or with fewer false alarms than in prior art systems.

Figure 3:
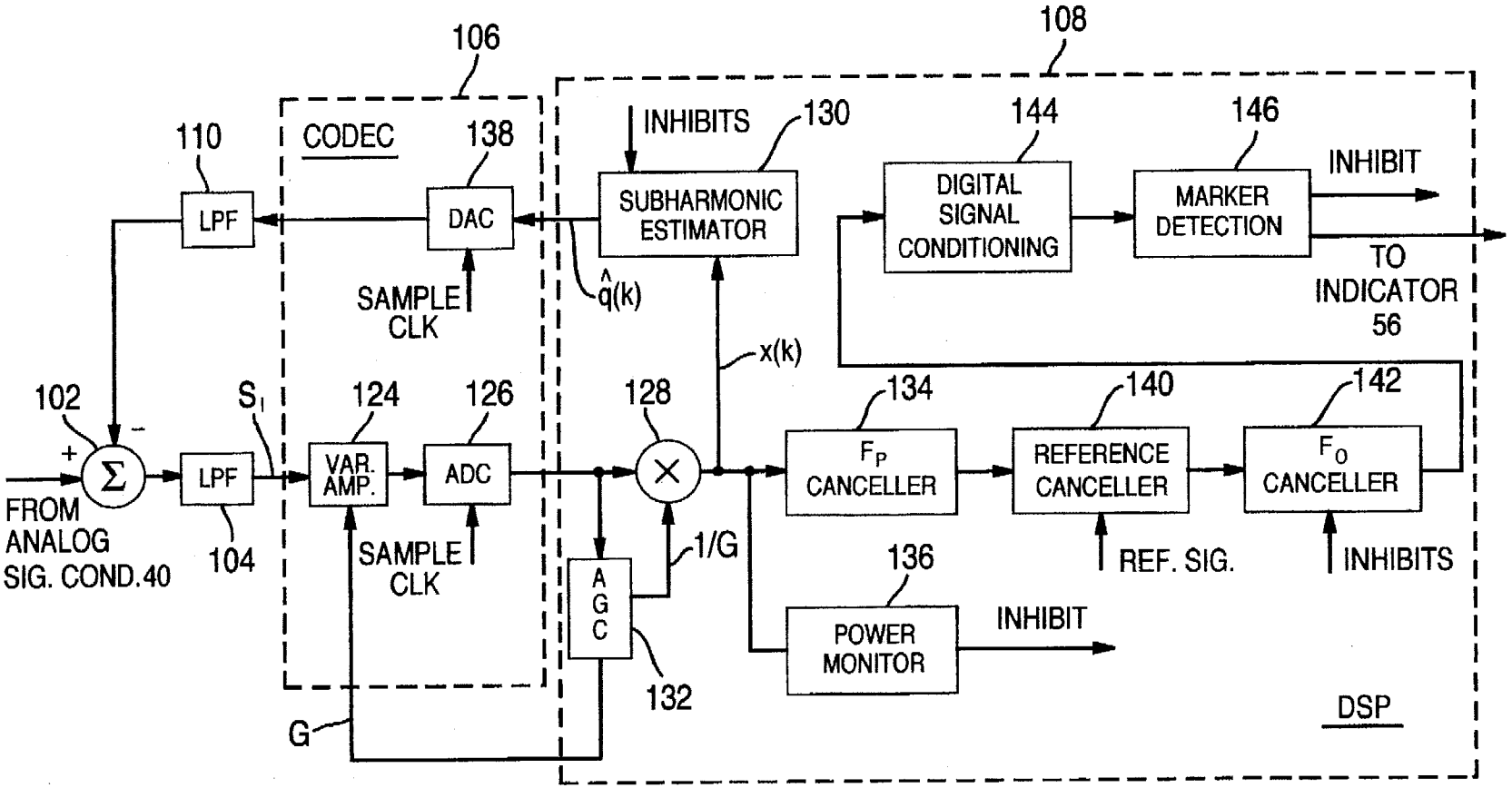
FIG. 3 illustrates in functional block form details of signal processing carried out by a codec circuit and a digital signal processing circuit that are part of the system of FIG. 2.

Benefits from the practices disclosed herein can be realized without implementing all of the techniques illustrated in FIG. 3. For example, it is contemplated to omit one or more of the hybrid subharmonic interference cancelling loop implemented using the subharmonic estimator 130 and the summing junction 102, the $F_p$ canceller 134, the reference canceller 140, the $F_o$ canceller 142 and the digital signal conditioning block 144. It is also contemplated to carry out subharmonic estimation and cancellation entirely digitally within the DSP 108. The hybrid AGC loop implemented with the AGC processing block 132 and the variable amplifier block 124 may also be omitted. Moreover, it is contemplated to omit one or more of the features described above relating to inhibiting updating of interference component estimates.

Although the preferred embodiment of the system, as described up to this point, operates with a transmitter frequency of 73.125 Hz, other transmitter frequencies are contemplated. In particular, the transmitter frequency may be selected as a relatively low harmonic of 10 Hz or 20 Hz so that the subharmonic estimator can operate with a lower value of M. For example, the transmitter frequency could be 80 Hz, in which case $F_{subharmonic}$ would be 20 Hz, and M would be 936 for the subharmonic estimator 130. Alternatively, if the transmitter frequency were selected to be 60 Hz, then the $F_p$ canceller 134 and the $F_o$ 142 could be omitted in favor of a hybrid interference cancelling loop in which the subharmonic estimator 130 would be implemented with M=312, and with some variations among the subsequence estimators making up the subharmonic estimator 130. It should, however, be noted that using a transmitter frequency such as 80 Hz or 60 Hz might make it desirable to modify the marker detection process.

Various other changes in the foregoing apparatus and modifications in the described practices may be introduced without departing from the invention. The particularly preferred methods and apparatus are thus intended in an illustrative and not limiting sense. The true spirit and scope of the invention is set forth in the following claims.

What is claimed is:

1. An electronic article surveillance system, comprising:

means for generating and radiating an interrogation signal which alternates at a predetermined frequency in an interrogation zone;

antenna means for receiving a signal present in the interrogation zone; and interference cancelling means for removing interference from an analog signal representative of said signal received by said antenna means, said interference cancelling means including:

means for subtracting an analog estimated interference signal from said analog signal to form a processed analog signal;

A/D conversion means for converting said processed analog signal into a sequence of digital samples;

digital signal processing means for processing said sequence of digital samples to form a digital estimate signal representative of an estimate of interference present in said analog signal; and D/A conversion means for converting said digital estimate signal into said analog estimated interference signal to be subtracted from said analog signal by said means for subtracting.

2. An electronic article surveillance system according to claim 1, wherein said digital signal processing means processes said sequence of digital samples by:

forming M subsequences from said sequence of digital samples, M being a positive integer greater than 1;

estimating a respective mean of each of said M subsequences; and combining the estimated means of said M subsequences to form said digital estimate signal.

3. An electronic article surveillance system according to claim 2, wherein $M=F_{sample}+F_{subharmonic}$, where $F_{sample}$ is a rate at which said A/D conversion means forms said digital samples, $F_{subharmonic}$ is the largest frequency which has both $F_o$ and $F_p$ as harmonics, $F_o$ is said predetermined frequency of said interrogation signal, and $F_p$ is a standard power system operating frequency for an environment in which the electronic article surveillance system operates.

4. An electronic article surveillance system according to claim 3, wherein $F_o$=73.125 Hz, $F_p$=60 Hz, $F_{sample}$=18,720 HZ and M=9984.

5. An electronic article surveillance system according to claim 3, wherein $F_{subharmonic}$ is greater than or equal to 10 Hz.

6. An electronic article surveillance system according to claim 1, further comprising gain control means for receiving said sequence of digital samples, processing said sequence of digital samples to form a gain level signal, and applying a gain to said processed analog signal in accordance with said gain level signal.

7. An electronic article surveillance system according to claim 6, wherein said gain control means applies to said sequence of digital samples a gain that is the inverse of said gain applied to said processed analog signal.

8. An electronic article surveillance system according to claim 1, further comprising inhibit means for detecting a characteristic of said sequence of digital samples, and for selectively inhibiting said interference cancelling means from updating said digital estimate signal in response to said detected characteristic of said sequence of digital samples.

9. An electronic article surveillance system according to claim 8, wherein said detected characteristic of said sequence of digital samples is a power level represented by said sequence of digital samples.

10. An electronic article surveillance system according to claim 8, wherein said detected characteristic of said sequence of digital samples is a characteristic indicative of a likelihood that an EAS marker is present in the interrogation zone.

11. An electronic article surveillance system according to claim 1, further comprising inhibit means having an input connected upstream from said interference cancelling means for receiving a signal representative of said signal received by said antenna means, said inhibit means for detecting a characteristic of said signal received at said input, and for selectively inhibiting said interference cancelling means from updating said digital estimate signal in accordance with said detected characteristic of said signal received at said input.

12. An electronic article surveillance system according to claim 11, wherein said detected characteristic is a level of said signal received at said input.

13. An electronic article surveillance system, comprising:

means for generating and radiating an interrogation signal which alternates at a predetermined frequency in an interrogation zone;

antenna means for receiving a signal present in the interrogation zone;

gain amplifier means for applying a gain to an analog signal representative of said signal received by said antenna means to form an amplified analog signal; said gain being in accordance with a gain setting signal supplied to said gain amplifier means;

A/D conversion means for converting said amplified analog signal into a sequence of digital samples; and digital signal processing means for processing said sequence of digital samples to form said gain setting signal to be supplied to said gain amplifier means.

14. An electronic article surveillance system according to claim 13, wherein said digital signal processing means applies to said sequence of digital samples a gain that is the inverse of said gain applied by said gain amplifier means.

15. An electronic article surveillance system according to claim 13, wherein said A/D conversion means includes a coder-decoder integrated circuit and said digital processing means includes a digital signal processor integrated circuit connected to said coder-decoder integrated circuit.

16. An electronic article surveillance system according to claim 13, wherein said digital signal processing means is programmed to:

form from said sequence of digital samples a level signal indicative of a level of said sequence of digital samples;

compare said level signal to a desired level setting; and selectively modify said gain setting signal on the basis of a result of said comparison of said level signal and said desired level setting.

17. An electronic article surveillance system according to claim 16, wherein said digital signal processing means does not modify said gain setting signal unless said level signal differs from said desired level setting by more than a predetermined amount.

18. An electronic article surveillance system according to claim 17, wherein said predetermined amount is substantially 2 dB.

19. An electronic article surveillance system, comprising:

means for generating and radiating an interrogation signal which alternates at a predetermined frequency in an interrogation zone;

antenna means for receiving a signal present in the interrogation zone;

first means for processing said signal received by said antenna means to form a sequence of digital samples; and digital signal processing means for forming M subsequences from said sequence of digital samples, M being a positive integer greater than 1, estimating a respective mean of each of said M subsequences, combining the estimated means of said M subsequences to form a digital estimate signal consisting of a sequence of digital estimate samples, and subtracting each sample of said sequence of digital estimate samples from a corresponding sample of said sequence of digital samples to form a sequence of processed digital samples.

20. An electronic article surveillance system according to claim 19, wherein said digital signal processing means estimates the respective mean of each of said M subsequences by performing low-pass filtering with respect to each of said M subsequences.

21. An electronic article surveillance system according to claim 19, wherein $M=F_{sample}+F_{subharmonic}$, where $F_{sample}$ is a sampling rate at which said digital samples are formed, $F_{subharmonic}$ is the largest frequency which has both $F_o$ and $F_p$ as harmonics, $F_o$ is said predetermined frequency of said interrogation signal, and $F_p$ is a standard power system operating frequency for an environment in which the electronic article surveillance system operates.

22. An electronic article surveillance system according to claim 19, wherein $M=F_{sample}+F_o$, where $F_{sample}$ is a sampling rate at which said digital samples were formed and $F_o$ is said predetermined frequency of said interrogation signal.

23. An electronic article surveillance system according to claim 19, wherein $M=F_{sample}+F_p$, where $F_{sample}$ is a sampling rate at which said digital samples were formed and $F_p$ is a standard power system operating frequency for an environment in which the electronic article surveillance system operates.

24. An electronic article surveillance system according to claim 19, further comprising inhibit means for detecting a characteristic of said sequence of processed digital samples and for selectively inhibiting said digital signal processing means from updating said digital estimate signal in response to said detected characteristic of said sequence of processed digital signals.

25. An electronic article surveillance system according to claim 24, wherein said detected characteristic of said sequence of processed digital samples is a power level represented by said sequence of processed digital samples.

26. An electronic article surveillance system according to claim 24, wherein said detected characteristic of said sequence of processed digital samples is a characteristic indicative of a likelihood that an EAS marker is present in the interrogation zone.

27. An electronic article surveillance system according to claim 19, further comprising inhibit means having an input connected upstream from said first means for receiving said signal received by said antenna means, said inhibit means for detecting a characteristic of said signal received at said input, and for selectively inhibiting said digital signal processing means from updating said digital estimate signal in response to said detected characteristic of said signal received at said input.

28. An electronic article surveillance system according to claim 27, wherein said detected characteristic of said signal received at said input is a level of said signal.

29. An interference cancellation device for removing an interference component from a sequence of digital samples obtained by processing a signal received by an electronic article surveillance system, the cancellation device comprising:

means for forming M subsequences from said sequence of digital samples, M being a positive integer greater than 1, means for estimating a respective mean of each of said M subsequences, means for combining the estimated means of said M subsequences to form a digital estimate signal consisting of a sequence of digital estimate samples; and means for subtracting each sample of said sequence of digital estimate samples from a corresponding sample of said sequence of digital samples to form a sequence of processed digital samples.

30. An interference cancellation device according to claim 29, including a digital signal processing integrated circuit programmed to perform said subsequence-forming, estimating, combining and subtracting functions.

31. An interference cancellation device according to claim 30, wherein said sequence of digital samples from which said subsequences are formed is a sequence of input digital signals supplied to said digital signal processing integrated circuit.

32. An interference cancellation device according to claim 30, wherein said digital signal processing integrated circuit processes a sequence of input digital signals supplied to said circuit to form said sequence of digital samples from which said subsequences are formed.

33. An interference cancellation device according to claim 29, wherein said means for estimating includes means for performing digital low-pass filtering with respect to each of said M subsequences.

34. An interference cancellation device according to claim 29, wherein $M=F_{sample}+F_{subharmonic}$, where $F_{sample}$ is a sample rate at which said sequence of digital samples is formed, $F_{subharmonic}$ is the largest frequency which has both $F_o$ and $F_p$ as harmonics, $F_o$ is an operating frequency at which said electronic article surveillance system generates an interrogation signal, and $F_p$ is a standard power system operating frequency for an environment in which said electronic article surveillance system operates.

35. An interference cancellation device according to claim 29, wherein $M=F_{sample}+F_o$, where $F_{sample}$ is a sample rate at which said sequence of digital samples is formed, and $F_o$ is an operating frequency at which said electronic article surveillance system generates an interrogation signal.

36. An interference cancellation device according to claim 29, wherein $M=F_{sample}+F_p$, where $F_{sample}$ is a sample rate at which said sequence of digital samples is formed, and $F_p$ is a standard power system operating frequency for an environment in which said electronic article surveillance system operates.

37. An electronic article surveillance system, comprising:

means for generating and radiating an interrogation signal which alternates at a predetermined frequency in an interrogation zone;

antenna means for receiving a signal present in the interrogation zone;

analog signal conditioning means for applying a filtering function to said signal received by said antenna means to form a filtered analog signal;

means for subtracting an analog estimated interference signal from said filtered analog signal to form a processed analog signal;

A/D conversion means for converting said processed analog signal into a sequence of digital samples;

means for forming $M_1$ subsequences from said sequence of digital samples, $M_1$ being a positive integer greater than 1;

first estimation means for estimating a respective mean of each of said $M_1$ subsequences;

means for combining the estimated means of said $M_1$ subsequences to form a first digital estimate signal representative of a first interference component present in said processed analog signal;

D/A conversion means for converting said first digital estimate signal into said analog estimated interference signal to be subtracted from said filtered analog signal by said means for subtracting;

means for forming $M_2$ subsequences from said sequence of digital samples, $M_2$ being a positive integer greater than 1 and different from $M_1$;

second estimation means for estimating a respective mean of each of said M2 subsequences;

means for combining the estimated means of said $M_2$ subsequences to form a second digital estimate signal consisting of a sequence of second digital estimate samples representative of a second interference component present in said sequence of digital samples;

means for subtracting each sample of said sequence of second digital estimate samples from a corresponding sample of said sequence of digital samples to form a sequence of processed digital samples;

reference-based noise cancelling means for receiving said sequence of processed digital samples and a noise reference signal and for applying noise cancellation processing to said sequence of processed digital samples on the basis of said noise reference signal to form a sequence of second processed digital samples;

means for forming $M_3$ subsequences from said sequence of second processed digital samples, $M_3$ being a positive integer greater than 1 and different from each of $M_1$ and $M_2$;

third estimation means for estimating a respective mean of each of said $M_3$ subsequences;

means for combining the estimated means of said $M_3$ subsequences to form a third digital estimate signal consisting of a sequence of third digital estimate samples representative of a third interference component present in said sequence of processed digital samples;

means for subtracting each sample of said sequence of third digital estimate samples from a corresponding sample of said sequence of second processed digital samples to form a sequence of third processed digital samples;

digital signal conditioning means for applying a digital filtering function to said sequence of third processed digital samples to form a sequence of fourth processed digital samples; and detection processing means for receiving said sequence of fourth processed digital signals and for generating from said sequence of fourth processed digital signals a likelihood signal indicative of a likelihood that an electronic article surveillance marker is present in the interrogation zone.

38. An electronic article surveillance system according to claim 37, further comprising inhibit means for receiving said likelihood signal and comparing said likelihood signal with a predetermined threshold and, on the basis of said comparison, for selectively inhibiting said first and third estimation means from updating said estimated means of said $M_1$ subsequences and said $M_3$ subsequences, respectively.

39. An electronic article surveillance system according to claim 37, further comprising inhibit means for detecting a characteristic of said sequence of digital samples formed by said A/D conversion means for selectively inhibiting said first and third estimation means from updating said estimated means of said $M_1$ subsequences and said $M_3$ subsequences, respectively, in response to said detected characteristic of said sequence of digital samples.

40. An electronic article surveillance system according to claim 39, wherein said detected characteristic of said sequence of digital samples is a power level represented by said sequence of digital samples.

41. An electronic article surveillance system according to claim 37, further comprising inhibit means for detecting a characteristic of said signal received by said antenna means, and for selectively inhibiting said first and third estimation means from updating said estimated means of said $M_1$ subsequences and said $M_3$ subsequence, respectively, in response to said detected characteristic of said signal received by said antenna means.

42. An electronic article surveillance system according to claim 41, wherein said inhibit means receives said signal in analog form and said detected characteristic of said received signal is a level of said signal.

43. An electronic article surveillance system according to claim 37, wherein each of said functions of subsequence-forming, means-estimating, combining, sample-subtracting, noise cancellation processing, digital filtering and likelihood-signal-generating are performed by a single digital signal processing integrated circuit connected to receive said sequence of digital samples from said A/D conversion means.

44. An electronic article surveillance system according to claim 37, wherein $M_1$=9984, $M_2$=256 and $M_3$=312.

45. An electronic article surveillance system according to claim 37, further comprising gain control means for receiving said sequence of digital samples, processing said sequence of digital samples to form a gain level signal, and applying a gain to said processed analog signal in accordance with said gain level signal.

46. An electronic article surveillance system according to claim 45, wherein said gain control means applies to said sequence of digital samples a gain that is the inverse of said gain applied to said processed analog signal.

47. A method of removing an interference component from a signal received by an electronic article surveillance system, the method comprising the steps of:

filtering said received signal to form a filtered analog signal;

subtracting from said filtered analog signal an analog estimate signal, representative of an estimate of said interference component, to form a processed analog signal;

converting said processed analog signal into a sequence of digital samples;

processing said sequence of digital samples to form a digital estimate signal representative of said estimate of said interference component; and converting said digital estimate signal into said analog estimate signal to be subtracted from said filtered analog signal.

48. A method according to claim 47, wherein said step of processing said sequence of digital samples includes:

forming M subsequences from said sequence of digital samples, M being a positive integer greater than 1;

estimating a respective mean of each of said M subsequences; and combining the estimated means of said M subsequences to form said digital estimate signal.

49. A method according to claim 47, wherein $M=F_{sample}+F_{subharmonic}$, where $F_{sample}$ is a sample rate at which said sequence of digital samples is formed, $F_{subharmonic}$ is the largest frequency which has both $F_o$ and $F_p$ as harmonics, $F_o$ is an operating frequency at which said electronic article surveillance system generates an interrogation signal, and $F_p$ is a standard power system operating frequency for an environment in which said electronic article surveillance system operates.

50. A method according to claim 49, wherein $F_o$=73.125 Hz, $F_p$=60 Hz, $F_{sample}$=18,720 Hz and M=9984.

51. A method according to claim 47, further comprising the steps of:

processing said sequence of digital samples to form a gain level signal, and applying a gain to said processed analog signal in accordance with said gain level signal.

52. A method according to claim 51, further comprising the step of applying to said sequence of digital samples a gain that is the inverse of said gain applied to said processed analog signal.

53. A method of cancelling an interference component from a digital signal formed by processing a signal received by an electronic article surveillance system, the digital signal consisting of a sequence of digital samples, the method comprising the steps of:

forming M subsequences from said sequence of digital samples, M being a positive integer greater than 1;

estimating a respective mean of each of said subsequences;

combining the estimated means of said M subsequences to form a digital estimate signal consisting of a sequence of digital estimate samples representative of an estimate of said interference component; and subtracting each sample of said sequence of digital estimate samples from a corresponding sample of said sequence of digital samples.

54. A method according to step 53, wherein said step of estimating a respective mean of each subsequence includes digital low-pass filtering each subsequence.

55. A method according to claim 53, wherein $M=F_{sample}+F_{subharmonic}$, where $F_{sample}$ is a sample rate at which said sequence of digital samples is formed, $F_{subharmonic}$ is the largest frequency which has both $F_o$ and $F_p$ as harmonics, $F_o$ is an operating frequency at which said electronic article surveillance system generates an interrogation signal, and $F_p$ is a standard power system operating frequency for an environment in which said electronic article surveillance system operates.

56. A method according to claim 53, wherein $M=F_{sample}+F_o$, where $F_{sample}$ is a sample rate at which said sequence of digital samples is formed, and $F_o$ is an operating frequency at which said electronic article surveillance system generates an interrogation signal.

57. A method according to claim 53, wherein $M=F_{sample}+F_p$, where $F_{sample}$ is a sample rate at which said sequence of digital samples is formed, and $F_p$ is a standard power system operating frequency for an environment in which said electronic article surveillance system operates.

58. A method of performing automatic gain control with respect to a signal received by an electronic article surveillance system, the method comprising the steps of:

applying a gain to an analog signal formed by processing said received signal, said gain being applied in accordance with a gain setting signal;

converting said analog signal to which said gain has been applied into a sequence of digital samples; and processing said sequence of digital samples to form said gain setting signal.

59. A method according to claim 58, further comprising the step of applying to said sequence of digital samples a gain that is the inverse of said gain applied to said analog signal.

60. A method according to step 58, wherein said step of processing said sequence of digital samples includes forming therefrom a level signal indicative of a level of said sequence of digital samples, comparing said level signal to a desired level setting, and selectively modifying said gain setting signal on the basis of a result of said comparison of said level signal and said desired level setting.

61. A method according to claim 60, wherein said gain setting signal is not modified unless said level signal differs from said desired level setting by more than a predetermined amount.

62. A method according to claim 61, wherein said predetermined amount is substantially 2 dB.

63. An electronic article surveillance system, comprising:

means for generating and radiating an interrogation signal which alternates at a predetermined frequency in an interrogation zone;

antenna means for receiving a signal present in the interrogation zone;

means for processing said signal received by said antenna means to form a sequence of digital samples, said sequence of digital samples consisting of a sequence of sample frames, each sample frame corresponding to a respective cycle of said interrogation signal;

window means for sequentially selecting a respective subset of each of said sample frames, each said subset consisting of the samples present in a window period within the respective interrogation signal cycle, said window means adjusting a timing of said window period relative to said respective cycle according to a characteristic of the sample frame; and comb filter means for comb-filtering the sample frame subsets sequentially selected by said window means.

64. An electronic article surveillance system according to claim 63, wherein said window means includes means for estimating a phase, relative to the respective interrogation signal cycle, of a marker signal present in the respective sample frame, said window means adjusting said timing of said window period according to said estimated phase of said marker signal.

65. An electronic article surveillance system, comprising:

means for generating and radiating an interrogation signal which alternates at a predetermined frequency in an interrogation zone;

antenna means for receiving a signal present in the interrogation zone;

means for processing said signal received by said antenna means to form a sequence of digital samples, said sequence of digital samples consisting of a sequence of sample frames, each sample frame corresponding to a respective cycle of said interrogation signal, said sequence of sample frames respectively including marker signals that vary in phase from sample frame to sample frame, relative to the respective interrogation signal cycle; and means for estimating, relative to the respective interrogation signal cycle, phases of the marker signals included in said sample frames.

66. An electronic article surveillance system according to claim 65, wherein said means for estimating includes:

means for comb-filtering said marker signals included in said sample frames to form a filtered estimate of said marker signals; and means for cross-correlating said filtered estimate of said marker signals with a selected portion of a current one of said sample frames.

* * * * *

UNITED STATES PATENT AND TRADEMARK OFFICE

CERTIFICATE OF CORRECTION

PATENT NO. : 5,699,045

DATED : December 16, 1997

INVENTOR(S) : Frederick et. al

It is certified that error appears in the above-identified patent and that said Letters Patent are hereby corrected as shown below:

Col. 10, line 29, delete "$\hat{q}_{-1}(n+1)=\hat{q}(n)$" and insert -- $\hat{q}_{-1}(n+1)=\hat{q}_{-1}(n)$ --.

Col. 11, line 38, delete "is -1" and insert -- is +1 --.

Signed and Sealed this

Fifth Day of May, 1998

*Attest:*

*Attesting Officer*

BRUCE LEHMAN

*Commissioner of Patents and Trademarks*